US011528990B2

(12) United States Patent
Fanourgiakis et al.

(10) Patent No.: US 11,528,990 B2
(45) Date of Patent: Dec. 20, 2022

(54) VARIABLE PLANFORM SHELVING SYSTEM

(71) Applicant: Techni, LLC, Burlingame, CA (US)

(72) Inventors: George Fanourgiakis, Foster City, CA (US); Lawrence J. Brucia, San Anselmo, CA (US)

(73) Assignee: Techni, LLC, Foster City, CA (US)

( * ) Notice: Subject to any disclaimer, the term of this patent is extended or adjusted under 35 U.S.C. 154(b) by 30 days.

(21) Appl. No.: 16/726,704

(22) Filed: Dec. 24, 2019

(65) Prior Publication Data

US 2020/0128956 A1 Apr. 30, 2020

Related U.S. Application Data

(63) Continuation of application No. 15/842,592, filed on Dec. 14, 2017, now Pat. No. 10,542,819, which is a (Continued)

(51) Int. Cl.

| | |
|---|---|
| ***A47B 45/00*** | (2006.01) |
| ***A47B 47/00*** | (2006.01) |
| ***A47B 43/00*** | (2006.01) |
| ***A47B 57/06*** | (2006.01) |
| ***A47B 87/02*** | (2006.01) |
| ***A47F 7/00*** | (2006.01) |
| ***F21V 33/00*** | (2006.01) |

(Continued)

(52) U.S. Cl.

CPC ..... *A47B 45/00* (2013.01); *A47B 43/00* (2013.01); *A47B 47/0083* (2013.01); *A47B 57/06* (2013.01); *A47B 87/0215* (2013.01); *A47F 5/0018* (2013.01); *A47F 5/08* (2013.01); *A47F 5/10* (2013.01); *A47F 7/00* (2013.01); *F21V 33/0012* (2013.01); *A47B 2220/0077* (2013.01); *F21W 2131/301* (2013.01)

(58) Field of Classification Search

CPC ..... A47B 45/00; A47B 43/00; A47B 47/0083; A47B 57/06; A47B 87/0215; A47B 2220/0077; A47F 5/0018; A47F 5/08; A47F 5/10; A47F 7/00; F21V 33/0012; F21W 2131/301

USPC ..... 211/90.02, 134, 126.6, 144, 186, 150, 211/149, 169, 189, 175, 187; 108/180, 108/181, 185, 186, 102, 147.12, 137

See application file for complete search history.

(56) References Cited

U.S. PATENT DOCUMENTS 834,873 A * 10/1906 Curtis ..... E04F 13/04 52/671

1,372,741 A * 3/1921 Dickinson ..... E04F 13/04 52/671

(Continued)

*Primary Examiner* — Patrick D Hawn

(74) *Attorney, Agent, or Firm* — Kramer Levin Naftalis & Frankel LLP

(57) ABSTRACT

Variable planform shelving systems include a variable support platform and a support surface assembly that is supported by the variable support platform. The variable support platform includes frames that can be repositioned relative to each other to vary the planform of the variable support platform. The support surface assembly provides a support surface for supported items. The support surface assembly is flexible and/or comprised of a plurality of linked panels so that the support surface provided varies in response to variation in the planform of the variable support platform.

13 Claims, 35 Drawing Sheets

Related U.S. Application Data continuation of application No. 15/204,903, filed on Jul. 7, 2016, now Pat. No. 9,844,262, which is a continuation of application No. 14/341,675, filed on Jul. 25, 2014, now Pat. No. 9,386,846, which is a continuation of application No. PCT/US2013/023449, filed on Jan. 28, 2013, which is a continuation-in-part of application No. 13/359,016, filed on Jan. 26, 2012, now Pat. No. 8,950,602.

(60) Provisional application No. 61/702,157, filed on Sep. 17, 2012.

(51) Int. Cl.

| | |
|---|---|
| ***A47F 5/00*** | (2006.01) |
| ***A47F 5/08*** | (2006.01) |
| ***A47F 5/10*** | (2006.01) |
| *F21W 131/301* | (2006.01) |

(56) References Cited

U.S. PATENT DOCUMENTS 2,675,769 A * 4/1954 Dosker ..... E04B 7/00 52/641
2,694,611 A * 11/1954 Lorber ..... A47B 96/025 108/67
2,705,179 A * 3/1955 Hodgin ..... A47B 1/00 428/609
2,722,979 A * 11/1955 Janowitz ..... A47F 5/105 160/131
3,825,465 A * 7/1974 Stock ..... E04C 5/06 428/135
3,858,803 A * 1/1975 Gantert ..... B60B 39/12 238/14
4,221,032 A * 9/1980 Cousino ..... B21D 31/04 29/2
4,223,613 A * 9/1980 Yoshizawa ..... A47B 47/00 108/102
4,519,508 A * 5/1985 Gullett ..... A47B 57/04 108/107
4,553,523 A * 11/1985 Stohrer, Jr. ..... A47J 37/0694 126/152 B
5,537,936 A * 7/1996 Cordrey ..... B31F 1/20 108/51.3
5,572,924 A * 11/1996 Crnjanski ..... A47J 37/0694 99/426
5,676,263 A * 10/1997 Chang ..... A47B 57/26 108/147.13
6,076,692 A * 6/2000 Avot ..... B65D 21/086 220/4.03
6,142,321 A * 11/2000 West ..... A47B 45/00 108/143
6,321,741 B1 * 11/2001 Thompson ..... A47J 37/0772 126/25 A
6,823,773 B2 * 11/2004 Swinford ..... A47J 37/0694 99/426
7,182,210 B2 * 2/2007 Metcalf ..... A47B 96/025 211/119
7,246,711 B1 * 7/2007 Metcalf ..... A47B 45/00 211/106.01
7,587,973 B2 * 9/2009 Kaliveh ..... A47J 37/0694 99/449
7,857,329 B2 * 12/2010 Cai ..... B62B 3/04 280/47.35
7,878,344 B2 * 2/2011 Martin ..... F24C 15/16 211/153
8,042,477 B2 * 10/2011 Lee ..... A47B 87/007 108/147.12
8,051,890 B2 * 11/2011 Broyan ..... E06B 3/928 160/201
8,065,999 B2 * 11/2011 Educate ..... A47J 37/0694 126/153
8,776,876 B2 * 7/2014 Hart ..... E21B 43/103 166/207
9,204,757 B2 * 12/2015 Atlaw ..... A47J 37/0694
9,516,990 B2 * 12/2016 Graute ..... A47L 15/504
9,756,980 B1 * 9/2017 Li ..... A23L 13/00
10,273,676 B2 * 4/2019 Wyllie ..... E04C 3/38
2006/0016774 A1 * 1/2006 Bustos ..... A47B 57/04 211/186
2006/0213403 A1 * 9/2006 Witt ..... A47B 81/002 108/180
2007/0138116 A1 * 6/2007 Metcalf ..... A47B 96/025 211/90.01
2007/0256387 A1 * 11/2007 Dorsy ..... E04C 2/427 52/588.1
2010/0126076 A1 * 5/2010 Broyan ..... E06B 3/928 49/404
2010/0155280 A1 * 6/2010 Graute ..... A47L 15/504 206/372
2012/0000867 A1 * 1/2012 Saving ..... A47B 45/00 211/59.2
2019/0249408 A1 * 8/2019 Wyllie ..... E04B 1/1903
2020/0297110 A1 * 9/2020 Lim ..... A47B 55/02

* cited by examiner

FIG. 20
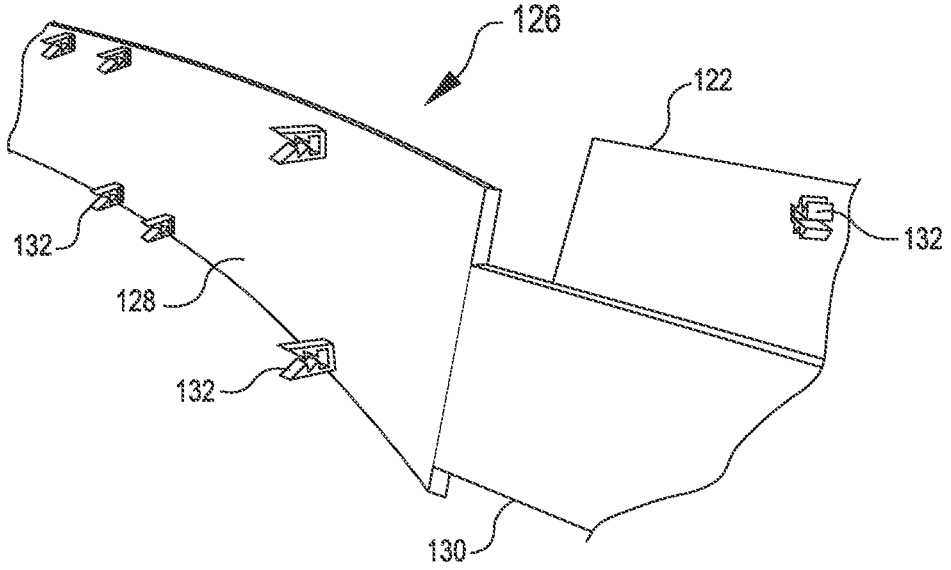
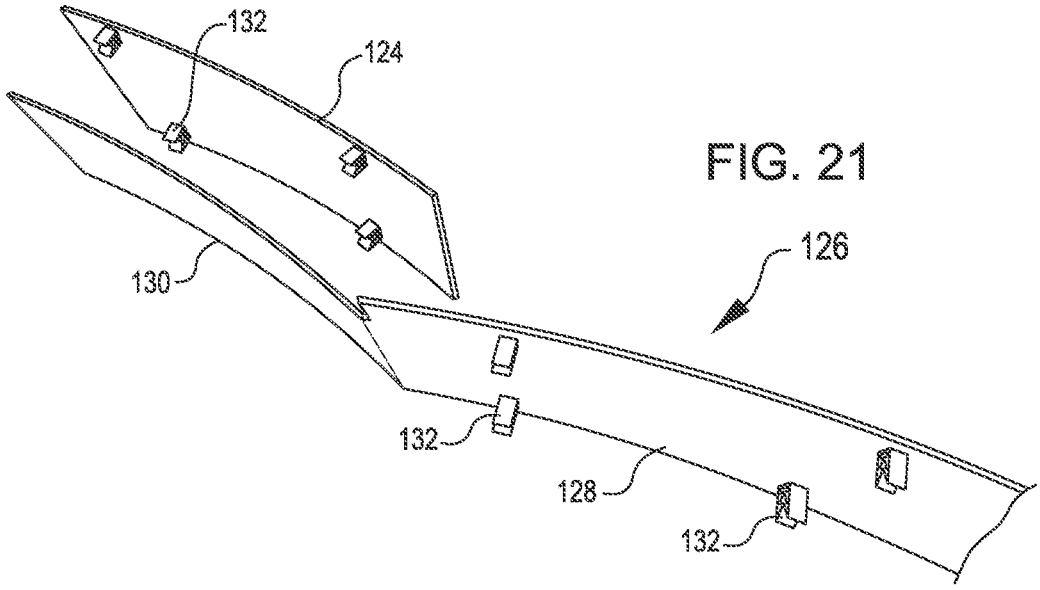
FIG. 21
FIG. 22
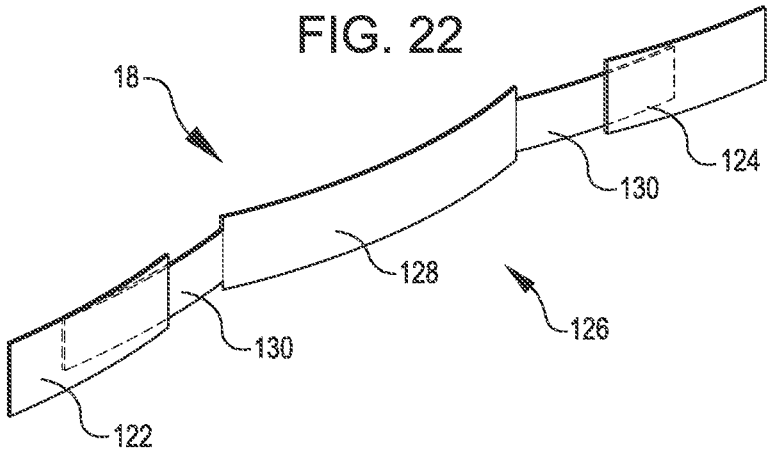

FIG. 52
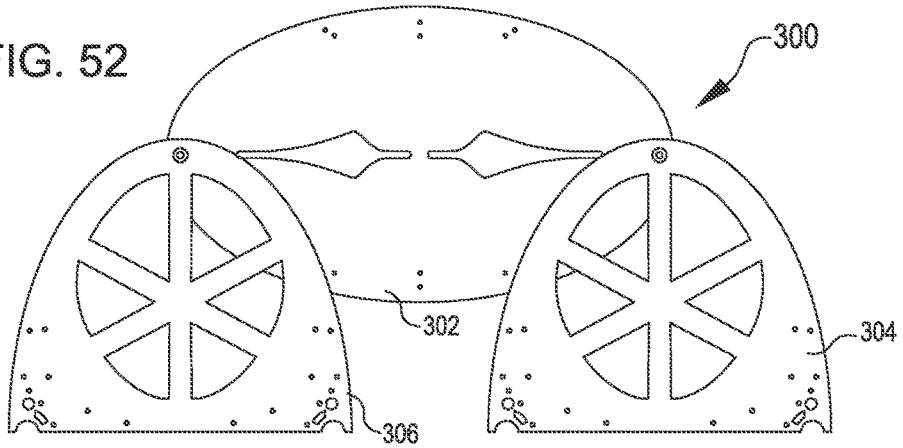
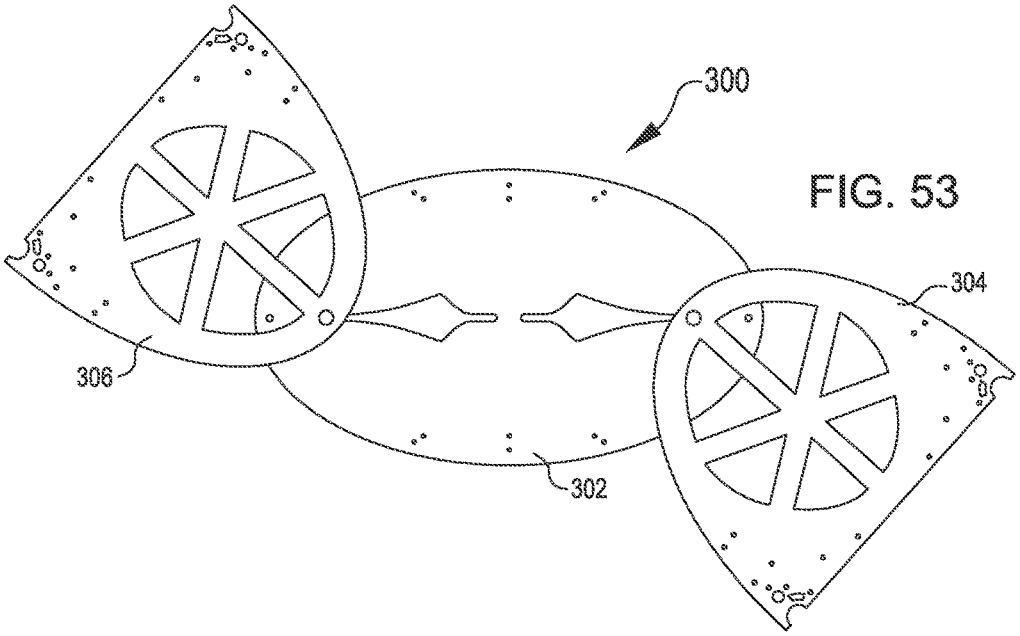
FIG. 53

VARIABLE PLANFORM SHELVING SYSTEM

CROSS-REFERENCES TO RELATED APPLICATIONS

This application is a continuation of U.S. application Ser. No. 15/842,592, filed Dec. 14, 2017, which application is a continuation of U.S. application Ser. No. 15/204,903, filed Jul. 7, 2016, now issued U.S. Pat. No. 9,844,262, which application is a continuation of U.S. application Ser. No. 14/341,675, filed Jul. 25, 2014, now issued U.S. Pat. No. 9,386,846, which application is a continuation of PCT/US2013/023449, filed Jan. 28, 2013, which application claims the benefit of U.S. Provisional Application No. 61/702,157, filed Sep. 17, 2012. PCT/US2013/023449 is also a Continuation-in-Part of U.S. application Ser. No. 13/359,016, filed Jan. 26, 2012, now Issued U.S. Pat. No. 8,950,602, the entire contents of which are all hereby incorporated by reference for all purposes.

BACKGROUND

Shelves are often used for displaying and/or storing items. For example, a retail outlet, such as a grocery store, typically includes multiple rows of shelves separated by aisles. The rows of shelves typically include shelves having differing configurations suitable for the different types of merchandise being displayed and/or stored.

Many existing shelving systems can be customized to some extent for the display and/or storage of particular items. For example, the number of shelves used and/or the vertical spacing between shelves can often be varied. And the size of the shelves used can be selected in advance based on the space available for the shelf. Existing shelving systems, however, may be insufficiently reconfigurable to avoid having to be replaced with new shelves of a different configuration as part of a reconfiguration of a retail outlet or remodeling of a residence.

Accordingly, there is believed to be a need for shelving systems and related items that can be reconfigured to a greater extent than existing shelving systems.

BRIEF SUMMARY

Shelves, shelving systems, and related items (e.g., tables, clothes racks) having a variable planform are disclosed. The assemblies disclosed herein include a variable support platform, which can be resized and/or reshaped, and can include a support surface assembly that is supported by the variable support platform. The support surface assembly provides a support surface that is resized and/or reshaped in response to resizing and/or reshaping of the variable support platform. Accordingly, the shelving assemblies and related items disclosed herein have increased flexibility to be reconfigured into desired shapes and/or sizes relative to existing shelving assemblies.

In various embodiments, a variable planform shelving system is provided having at least a shelf having a variable planform. The shelf can comprise two or more frames, and each frame can provide a part of a variable support platform. Each frame can comprise at least one interaction end configured for interacting with another frame, and at least one frame can be coupled with an adjacent frame near an interaction end so that the coupled adjacent frames can move relative to one another to adjust the planform of the shelf.

In many embodiments, a shelf is provided that has a variable planform. The shelf includes a first frame providing a first part of a variable support platform, a second frame providing a second part of the variable support platform, and a support surface assembly that is supported by the variable support platform and provides a support surface for items supported by the shelf. Relative positioning between the first and second frames is variable so as to vary the planform of the variable support platform. The support surface assembly is flexible and/or includes a plurality of linked panels so that the support surface provided varies in response to variation in the planform of the variable support platform. In many embodiments, relative orientation of the first and second frames is variable to vary the shape of the planform of the variable support platform.

In many embodiments, the shelf further includes a third frame providing a third part of the variable support platform. The third frame is disposed between the first and second frames. Relative positioning between the third frame and each of the first and second frames is variable to vary the planform of the variable support platform. For example, the third frame can be slidingly coupled with each of the first and second frames.

In many embodiments, relative orientation between the first and third frames is variable to vary the shape of the planform of the variable support platform. And in many embodiments, relative orientation between the second and third frames is variable to vary the shape of the planform of the variable support platform.

The first, second, and third frames can have suitable details that contribute to providing the variable support platform. For example, the first frame and/or the second frame can have a slot that receives a portion of the third frame. In many embodiments, each of the first, second, and third frames has an upper surface that interfaces with the support surface assembly with the upper surfaces being coplanar. In many embodiments, the first frame and/or the second frame has a planform shape of half of an ellipse and the third frame has a planform shape of an ellipse. In many embodiments, the third frame includes an elongated aperture. The elongated aperture receives a first coupling pin coupled with the first frame and extending across the first frame slot. The elongated aperture further receives a second coupling pin coupled with the second frame and extending across the second frame slot. In many embodiments, each of the first frame and the second frame includes an end portion adapted to attach to a support at one end of the end portion.

In many embodiments, the shelf support surface assembly is configured such that the planform of the support surface assembly varies in response to variation in the planform of the variable support platform. For example, in many embodiments, the shelf support surface assembly includes a plurality of interconnected vertically-oriented flexible panels. The flexible panels are formed from a suitable material (e.g., polycarbonate). And in many embodiments, the shelf support surface assembly includes a plurality of coupled horizontally-oriented panels. For example, each of the horizontally-oriented panels can have one or more slots receiving connecting pins that couple adjacent panels of the horizontally-oriented panels.

In another aspect, a shelving system having a variable planform is provided. The shelving system includes a first shelf having a variable planform, a second shelf having a variable planform and being elevated above the first shelf, at least one first support column, and at least one second support column. In many embodiments, each of the first and second shelves include first, second, and third frames as described herein. The first support column(s) supports the first frames of the first and second shelves. And the second support column(s) supports the second frames of the first and second shelves. In many embodiments, one or more supplemental support columns are used.

In many embodiments, the shelving system includes a base. The base can include an upper portion that includes a shelf having a variable planform as describe herein, a lower portion that includes a shelf having a variable planform as described herein, at least one first column member attached to each of the first frames of the upper and lower portions, at least one second column member attached to each of the second frames of the upper and lower portions, and a plurality of third column members, each of the column members being attached to the third frames of the upper and lower portions.

In many embodiments, the shelving system includes a kick plate assembly attached to the base. The kick plate assembly can include a first kick plate member attached to at least one of the first frames of the upper and lower portions, a second kick plate member attached to at least one of the second frames of the upper and lower portions, and a third kick plate member attached to at least one of the third frames of the upper and lower portions. At least one of the first, second, or third kick plate members can include an extension panel overlapping an adjacent one of the first, second, or third kick plate members for a plurality of planform configurations of the base.

In many embodiments, the shelving system includes at least one price display assembly attached to at least one of the first and second shelves. The price display assembly can include a first price display segment attached to the first frame and configured to display a price tag, a second price display segment attached to the second frame and configured to display a price tag, and a third price display segment slidably coupled with at least one of the first and second price display segments. The third price display segment is flexible and configured to display a price tag.

In another aspect, a table having a variable planform is provided. The table includes a first upper frame forming a first part of a variable support platform, a second upper frame forming a second part of the variable support platform, a third upper frame providing a third part of the variable support platform, a support surface assembly providing a support surface for items supported by the table, a first base frame forming part of a variable base that is disposed below the variable support platform, a second base frame forming part of the variable base, a third base frame forming part of the variable base, and a plurality of intermediate members disposed between and attached to the variable base and the variable support platform. The third upper frame is disposed between the first and second upper frames. Relative positioning and orientation between the third upper frame and each of the first and second upper frames is variable so as to vary the planform of the variable support platform. The support surface assembly is supported by the variable support platform. The support surface assembly can be at least one of flexible or include a plurality of linked panels so that the support surface provided varies in response to variation in the planform of the variable support platform. The third base frame is disposed between the first and second base frames. Relative positioning and orientation between the third base frame and each of the first and second base frames is variable to vary the planform of the variable base.

In many embodiments, the intermediate members include a plurality of first intermediate members, a plurality of second intermediate members, and a plurality of third intermediate members. Each of the first intermediate members is attached to the first upper frame and the first base frame. Each of the second intermediate members is attached to the second upper frame and the second base frame. And each of the third intermediate members is attached to the third upper frame and the third base frame. Any suitable configuration of intermediate member can be used, for example, a column member.

In many embodiments, the table support surface assembly is configured such that the planform of the support surface assembly varies in response to variation in the planform of the variable support platform. For example, in many embodiments, the table support surface assembly includes a plurality of interconnected vertically-oriented flexible panels. As another example, in many embodiments, the table support surface assembly includes a plurality of coupled horizontally-oriented panels having one or more slots receiving coupling pins that couple adjacent panels of the horizontally-oriented panels.

For a fuller understanding of the nature and advantages of the present invention, reference should be made to the ensuing detailed description and accompanying drawings. Other aspects, objects and advantages of the invention will be apparent from the drawings and detailed description that follows.

BRIEF DESCRIPTION OF THE DRAWINGS

FIG. 20 and FIG. 21 are perspective views of components of the kick plate assembly of FIG. 17.

FIG. 22 is a perspective view of the kick plate assembly of FIG. 17 in an expanded configuration.

FIGS. 48-53 are top views showing multiple configurations for the support platform of FIG. 42.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
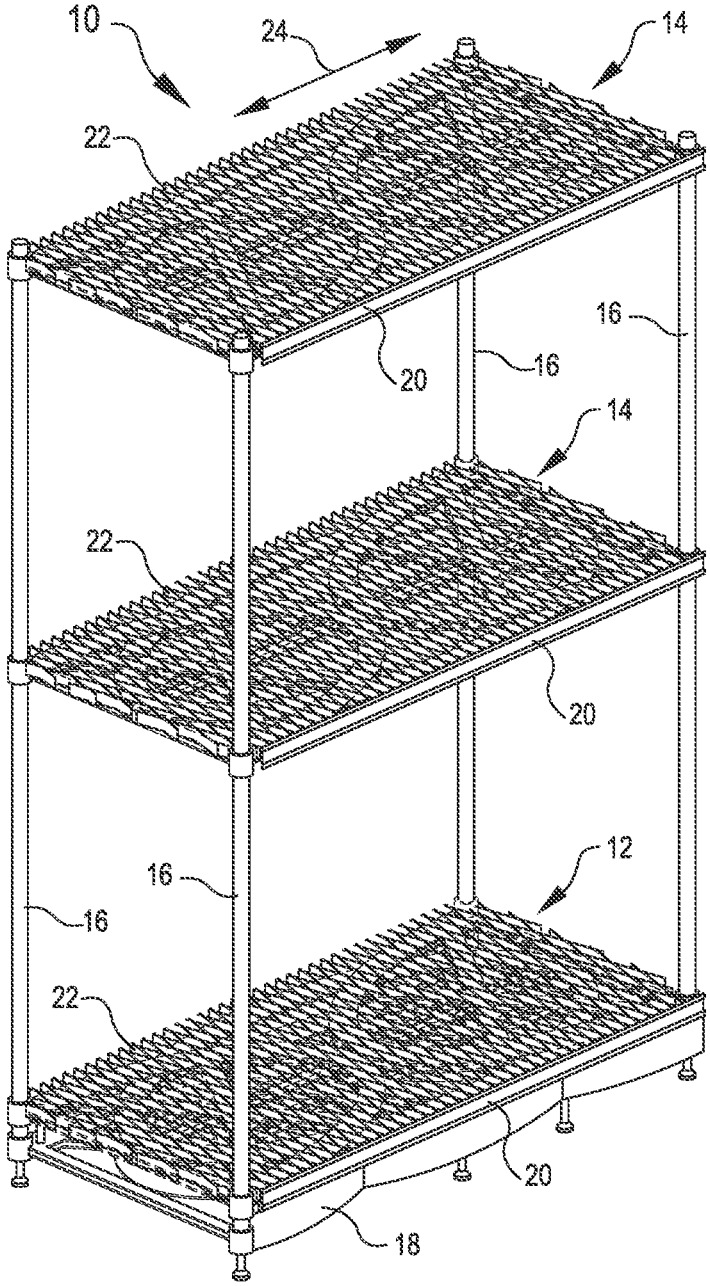
FIG. 1 is a perspective view of a variable-planform shelving system in a compact collapsed configuration, in accordance with many embodiments.

Referring now to the drawings, in which like reference numerals represent like parts throughout the several views, FIG. 1 shows a variable-planform shelving system 10, in accordance with many embodiments. The shelving system 10 is shown in a compact collapsed configuration. The shelving system 10 includes a variable-planform base 12, variable planform shelves 14, four support posts 16, a kick plate assembly 18, and price display assemblies 20. Although two variable planform shelves 14 are shown, the variable-planform shelving system 10 can include any suitable number of variable planform shelves 14 (e.g., 1 or more).

The variable-planform base 12 and each of the variable planform shelves 14 include a support surface assembly 22 that provides a support surface for items supported by the shelving system 10. In the embodiment shown, the support surface assemblies 22 are fabricated from a plurality of vertically-oriented panels that are intermittently bonded together such that a support surface assembly 22 can be expanded in a lengthwise direction 24 (perpendicular to the orientation of the vertically-oriented panels) without any substantial contraction perpendicular to the lengthwise direction 24. In addition to being expandable in the lengthwise direction 24, the support surface assembly 22 is flexible to conform to a variety of curved planforms in which the shelving system 10 can be configured.

Figure 2:
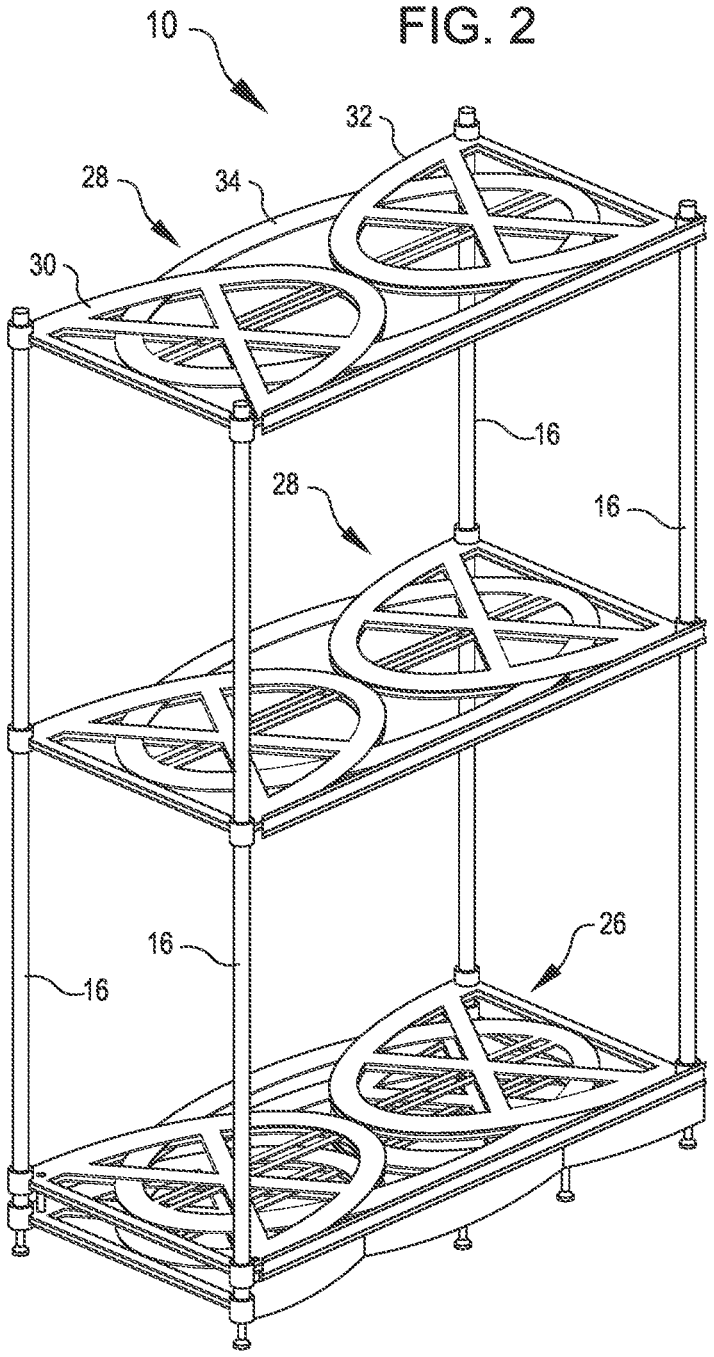
FIG. 2 is a perspective view of the variable-planform shelving system of FIG. 1 with support surface assemblies removed to show details of underlying shelf variable support platforms and a variable base.

FIG. 2 shows the shelving system 10 in the compact collapsed configuration with the support surface assemblies 22 removed to better show details of a base support platform 26 portion of the variable-planform base 12 and a variable support platform 28 portion of the shelves 14. The base support platform 26 supports a support surface assembly 22. Likewise, each of the variable support platforms 28 support a support surface assembly 22. The base support platform 26 and the variable support platforms 28 are supported by the four support posts 16.

The base support platform 26 and the variable support platforms 28 are reconfigurable into any of a continuous range of different planforms including expanded planforms, a variety of curved planforms, and combinations thereof. Each variable support platform 28 includes a first frame 30, a second frame 32, and a third frame 34. The third frame 34 has an elliptical outer perimeter. Each of the first and second frames 30, 32 have an outer perimeter shape of a half ellipse.

Generally, in mathematician terms, an ellipse in two dimensions is symmetric and defined by a continuous perimeter, a major axis, and a minor axis. The major axis intersects three major reference points of the ellipse: a first point on a perimeter of the ellipse corresponding to a greatest diameter of the ellipse, a second point on the perimeter of the ellipse corresponding to an opposite end of the greatest diameter of the ellipse, and a center point of the ellipse located equidistant from each of the first point and the second point. The minor axis intersects three pertinent reference points of the ellipse: a third point on a perimeter of the ellipse corresponding to a smallest diameter of the ellipse, a fourth point on the perimeter of the ellipse corresponding to an opposite end of the smallest diameter of the ellipse, and the center of the ellipse, which is also equidistant from each of the third point and the fourth point. However, such a definition fails to convey the full meaning of the terms "ellipse" or "elliptical" for the purposes of this disclosure. Herein, such terms not only includes the mathematician's ellipse, but refers also to any elongate circle, regardless of symmetry, and any portion thereof. Thus a partial ellipse may include any segment of an elliptical perimeter or any area cut out of an ellipse, regardless of how small or large any curved edges may be. Additionally, a reference to an ellipse would include any elongated circular shape having any sides, ends, or edges trimmed off.

A first portion of the third frame 34 can be slidably received within a horizontally-oriented slot in the first frame 30 and a second portion of the third frame 34 is slidably received within a horizontally-oriented slot in the second frame 32. The planform of the variable support platform 28 is selectively varied by repositioning and/or reorienting the third frame 34 relative to the first frame 30 and/or relative to the second frame 32.

Figure 3:
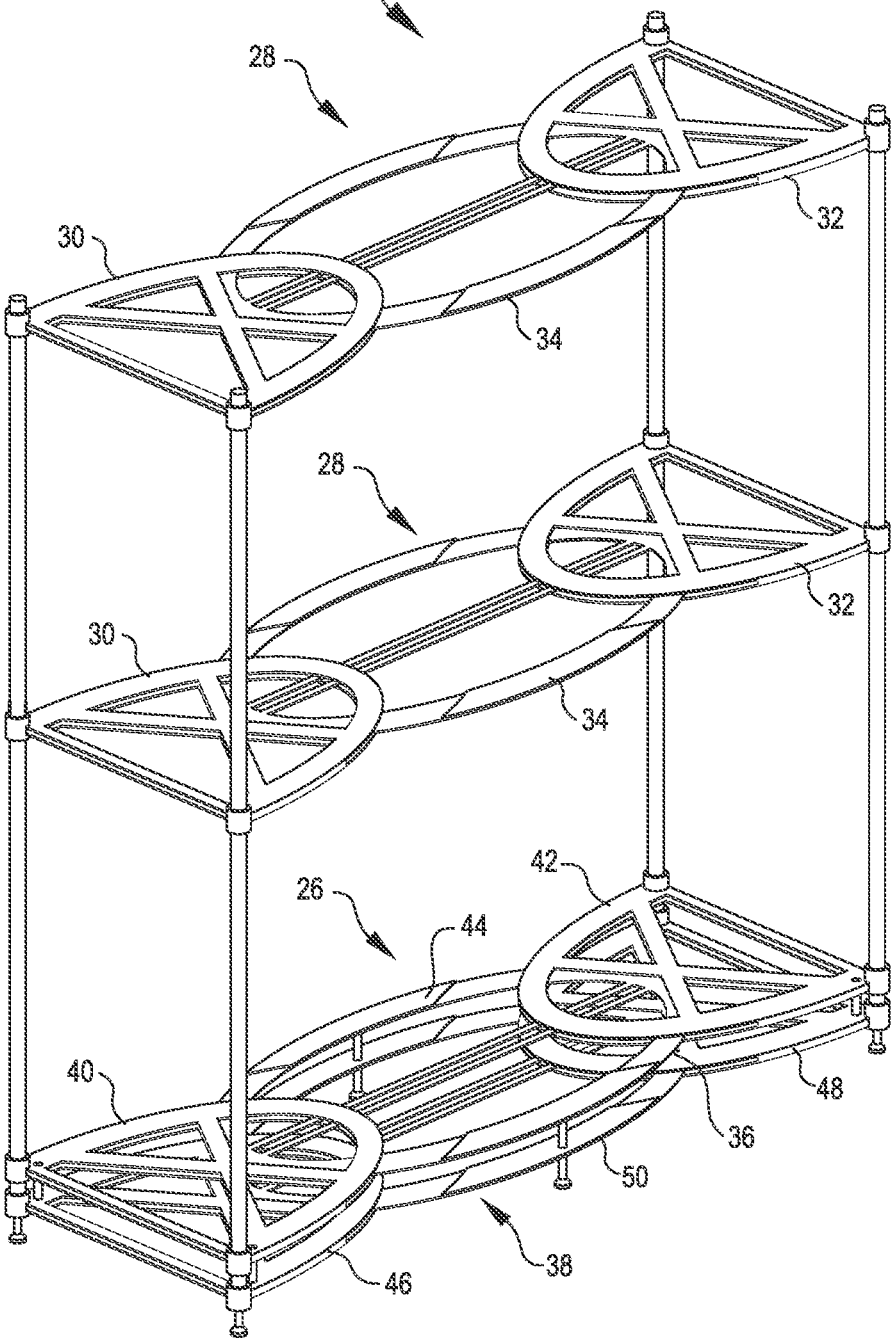
FIG. 3 is a perspective view of the variable-planform shelving system of FIG. 1 in a partially-expanded configuration with the support surface assemblies removed to show details of the underlying shelf variable support platforms and the variable base.

In a similar fashion, the planform of the base support platform 26 can be selectively varied. The planform of the base support platform 26 and the planform of each of the variable support platforms 28 can be varied in the same way so that each of the support posts 16 remains vertical. For example, FIG. 3 shows the shelving system 10 in a partially expanded configuration with the support surface assemblies 22 removed to better show the partially expanded states of the base support platform 26 and the variable support platforms 28.

The base support platform 26 includes an upper portion 36 and a lower portion 38. The upper portion 36 includes a first upper frame 40, a second upper frame 42, and a third upper frame 44 that are configured similar to the first, second, and third frames 30, 32, 34 of the variable support platforms 28. The third upper frame 44 has an elliptical outer perimeter. Each of the first and second upper frames 40, 42 has an outer perimeter in the shape of a half ellipse. A first portion of the third upper frame 44 is slidably received within a horizontally-oriented slot in the first upper frame 40 and a second portion of the third upper frame 44 is slidably received within a horizontally-oriented slot in the second upper frame 42. Likewise, the lower portion 38 includes a first lower frame 46, a second lower frame 48, and a third lower frame 50 that are configured similar to the first, second, and third frames 30, 32, 34 of the variable support platforms 28. The third lower frame 50 has an elliptical outer perimeter. Each of the first and second lower frames 46, 48 has an outer perimeter in the shape of a half ellipse. A first portion of the third lower frame 50 is slidably received within a horizontally-oriented slot in the first lower frame 46 and a second portion of the third upper frame 50 is slidably received within a horizontally-oriented slot in the second lower frame 48. The planform of the base support platform 26 is selectively varied by repositioning and/or reorienting the third upper and third lower frames 44, 50 relative to the first upper and first lower frames 40, 46 and/or relative to the second upper and second lower frames 42, 48.

Figure 4:
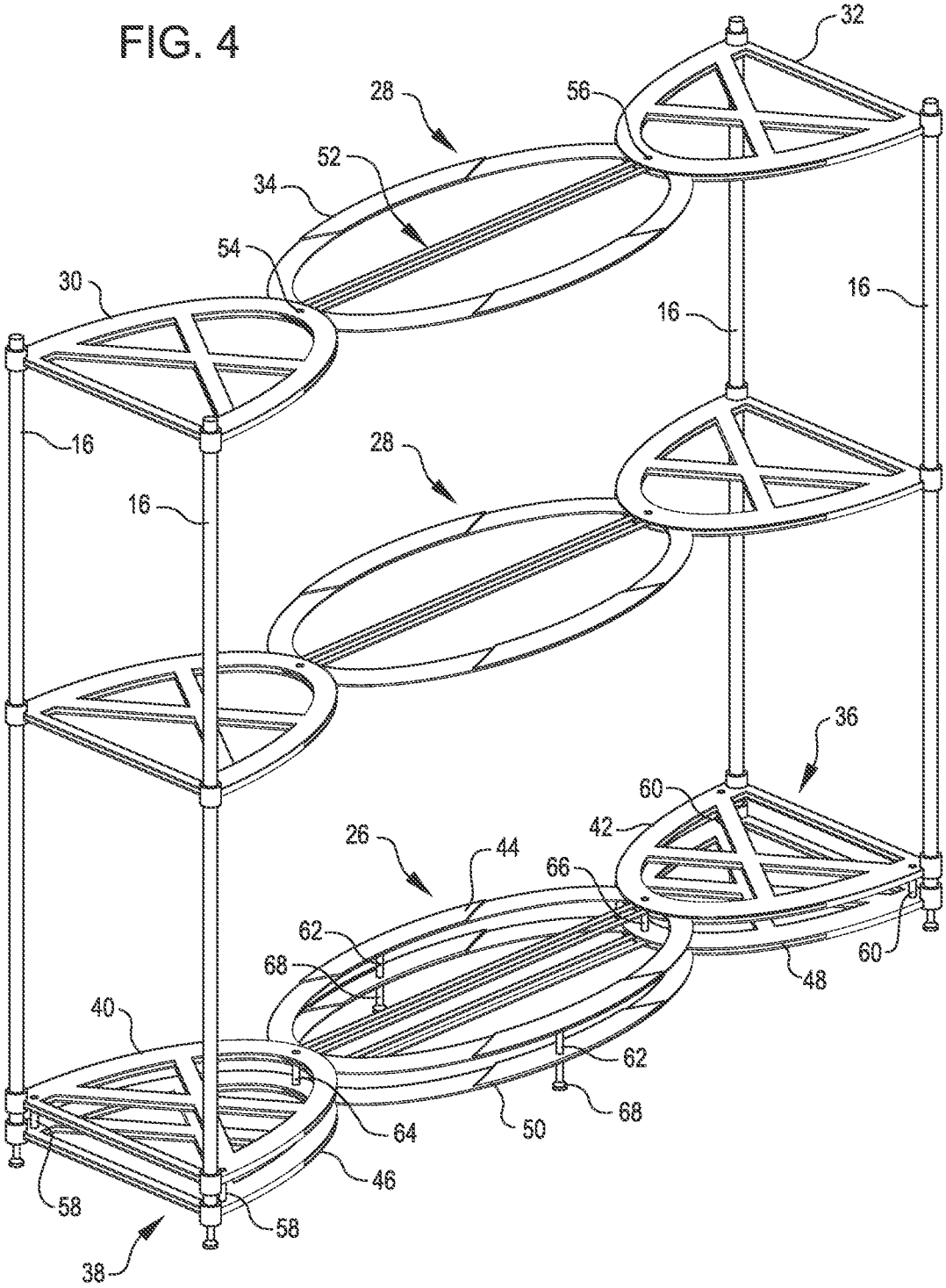
FIG. 4 is a perspective view of the variable-planform shelving system of FIG. 1 in a fully-expanded configuration with the support surface assemblies removed to show details of the underlying shelf variable support platforms and the variable base.

Additional details of the shelving system 10 will now be described with reference to FIG. 4, which shows the shelving system 10 in a fully expanded in-line configuration. As shown, the third frame 34 of the variable support platforms 28 has an elongated aperture 52 that extends from one end of the third frame 34 to the other. The elongated aperture 52 receives a first coupling pin 54 that is coupled with the first frame 30 and extends across the first frame slot, thereby extending through the elongated aperture 52. The elongated aperture 52 further receives a second coupling pin 56 that is coupled with the second frame 32 and extends across the second frame slot, thereby extending through the elongated aperture 52. In the fully expanded in-line configuration, the coupling pins 54, 56 are disposed at opposing ends of the elongated aperture 52, thereby retaining the ends of the third frame 34 within the first and second frame slots. Additionally, the coupling pins 54, 56 can be configured to clamp the first and second frames 30, 32 onto the third frame, thereby preventing inadvertent reconfiguration of the variable support platform 28 and enhancing the transfer of bending moments from the third frame 34 to the first and second frames 30, 32. In many embodiments, suitable threaded fasteners are used as the coupling pins 54, 56.

The upper and lower portions 36, 38 of the base support platform 26 are connected by intermediate members (e.g., a column members). Adjacent to the support posts 16, the first upper and first lower frames 40, 46 are connected by two column members 58. Likewise, adjacent to the other support posts 16, the second upper and second lower frames 42, 48 are connected by two column members 60. The third upper and third lower frames 44, 50 are connected by two column members 62 disposed midway along opposing sides of the third upper and third lower frames 44, 50. A column member 64 connects the first upper and first lower frames 40, 46. The column member 64 can also be configured to clamp the first upper and first lower frames 40, 46 onto the third upper and third lower frames 44, 50, respectively, thereby preventing inadvertent reconfiguration of the base support platform 26 and enhancing the transfer of bending moments from the third upper and third lower frames 44, 50 to the first upper and first lower frames 40, 46. For example, a suitable threaded fastener can be used in conjunction with the column member 64 to provide the clamping force. A column member 66 connects the second upper and second lower frames 42, 48. The column member 66 can also be configured to clamp the second upper and second lower frames 42, 48 onto the third upper and third lower frames 44, 50, respectively, thereby preventing inadvertent reconfiguration of the base support platform 26 and enhancing the transfer of bending moments from the third upper and third lower frames 44, 50 to the second upper and second lower frames 42, 48. For example, a suitable threaded fastener can be used in conjunction with the column member 66 to provide the clamping force. A height adjustable support 68 is disposed directly below each of the column members 62 and helps to stabilize the base support platform 26.

Figure 5:
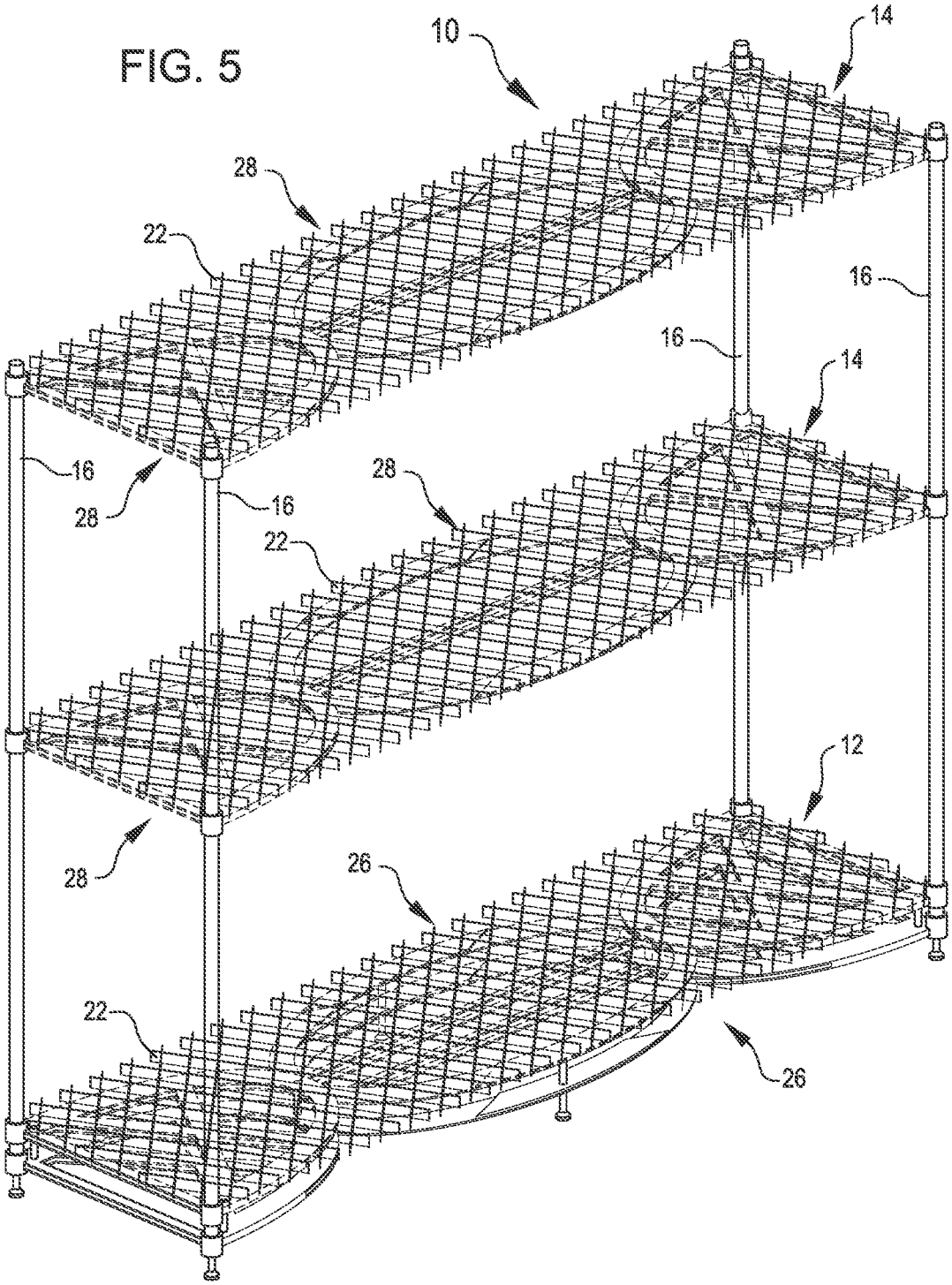
FIG. 5 is perspective view of the variable-planform shelving system of FIG. 1 in a fully-expanded configuration with the support surface assemblies not removed.

FIG. 5 shows the shelving system 10 in the fully expanded in-line configuration without the support surface assemblies 22 removed. In many embodiments, the support surface assemblies 22 are coupled with the underlying support platforms at suitable locations (e.g., along the ends and at intermediate points along the lengthwise edge) such that the planform of the support surface assemblies is constrained to conform to the planform of the underlying support platforms.

Figure 6:
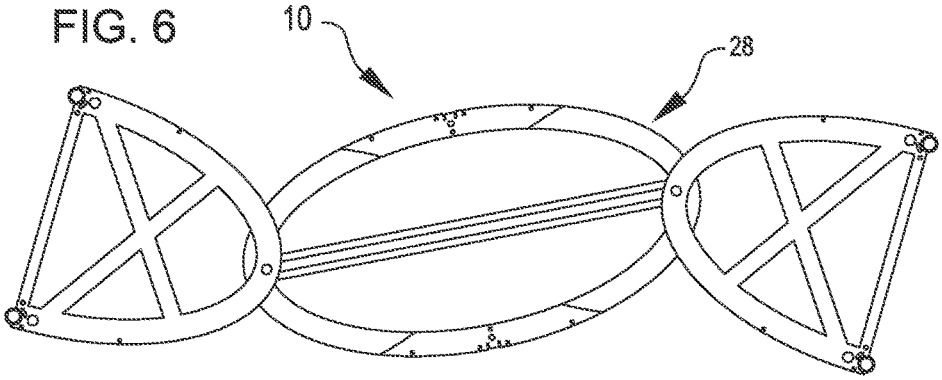
FIG. 6 is a top view of the variable-planform shelving system of FIG. 1 in a fully-expanded and curved configuration with the support surface assemblies removed to show details of the underlying shelf variable support platforms and the variable base.
Figure 7:
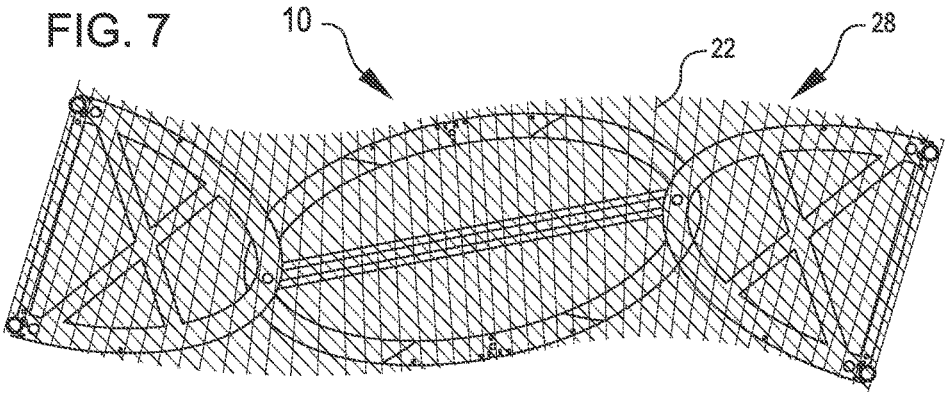
FIG. 7 is a top view of the variable-planform shelving system of FIG. 1 in the configuration of FIG. 6 with the support surface assemblies not removed.
Figure 8:
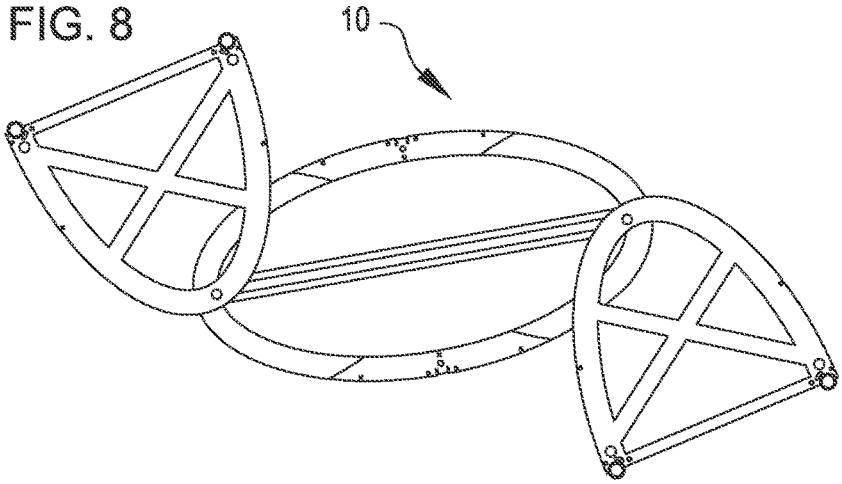
FIG. 8 is a top view of the variable-planform shelving system of FIG. 1 in another fully-expanded and curved configuration with the support surface assemblies removed to show details of the underlying shelf variable support platforms and the variable base.
Figure 9:
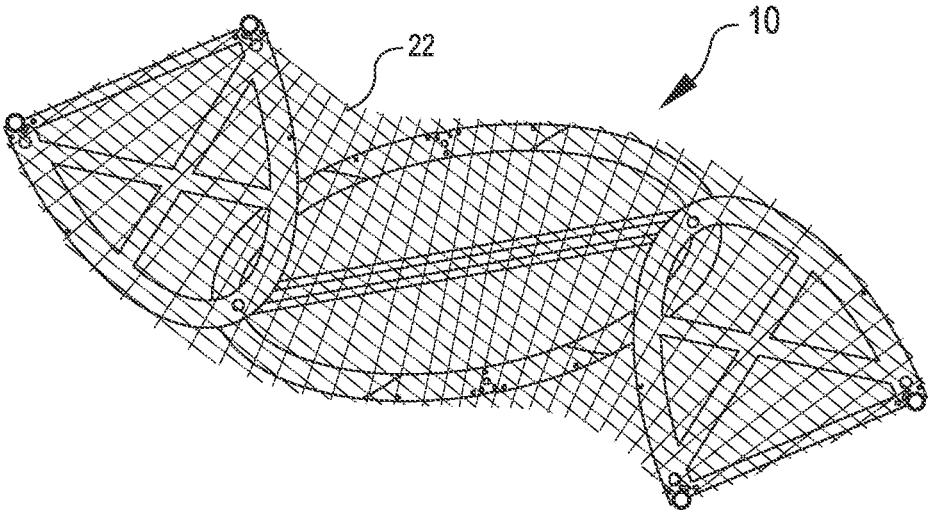
FIG. 9 is a top view of the variable-planform shelving system of FIG. 1 in the configuration of FIG. 8 with the support surface assemblies not removed.
Figure 10:
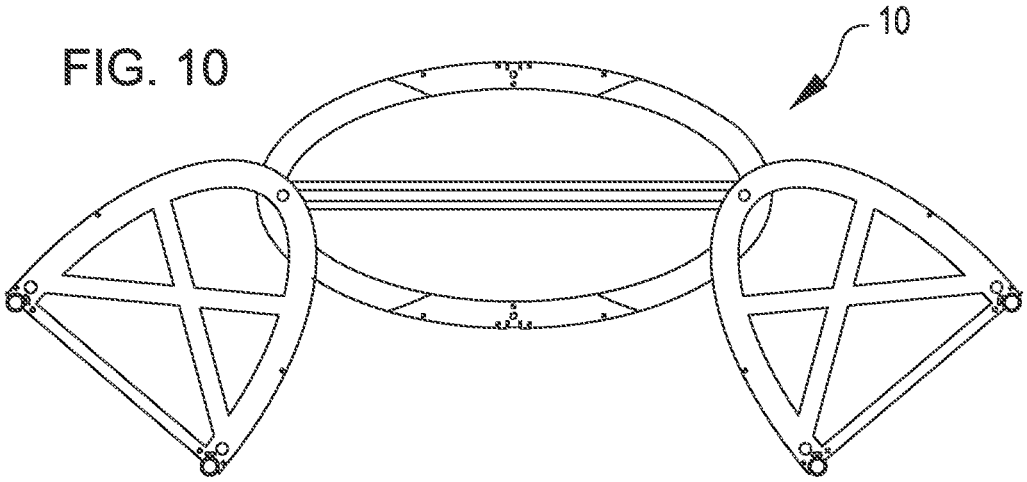
FIG. 10 is a top view of the variable-planform shelving system of FIG. 1 in another fully-expanded and curved configuration with the support surface assemblies removed to show details of the underlying shelf variable support platforms and the variable base.
Figure 11:
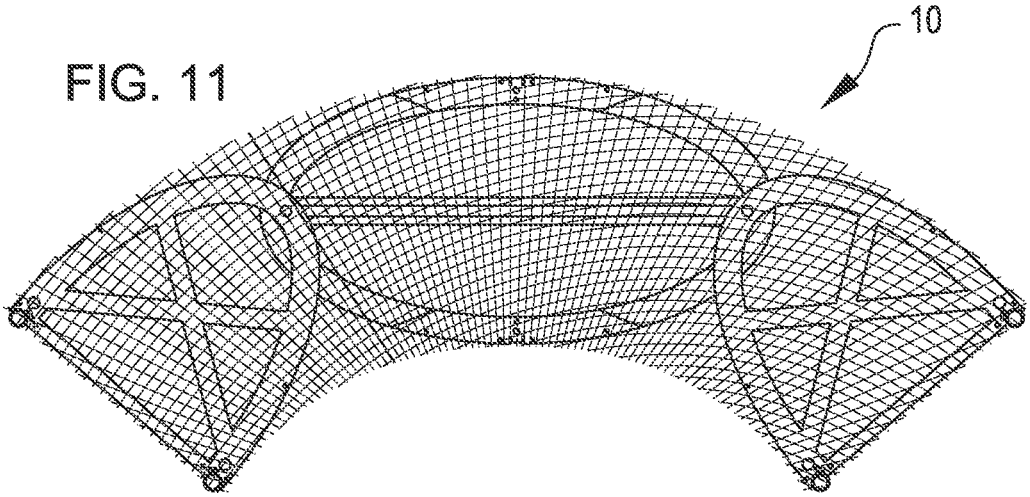
FIG. 11 is a top view of the variable-planform shelving system of FIG. 1 in the configuration of FIG. 10 with the support surface assemblies not removed.

FIG. 6 shows the shelving system 10 in a fully expanded curved configuration with the support surface assemblies 22 not shown to better illustrate the relative orientations between the frames of the base support platform 26 and the variable support platforms 28. FIG. 7 shows the same configuration with the support surface assemblies not removed. As shown, the planform of the variable support surface assemblies 22 varies to conform to the planform of the underlying support platforms. FIG. 8 and FIG. 9 show the shelving system 10 in another fully expanded curved configuration. And FIG. 10 and FIG. 11 show the shelving system 10 in yet another fully expanded curved configuration.

Figure 12:
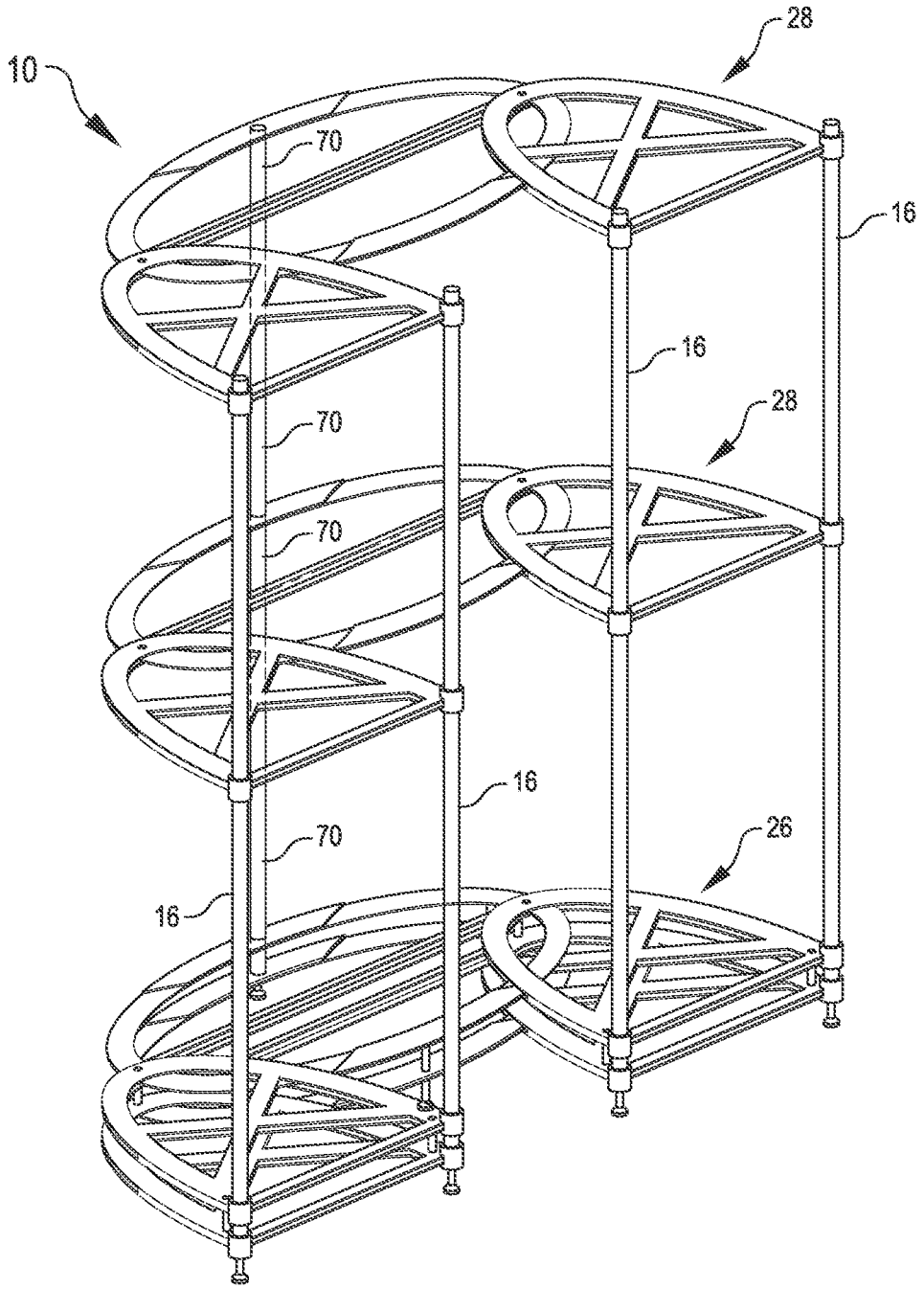
FIG. 12 is a perspective view of the variable-planform shelving system of FIG. 1 in another fully-expanded and curved configuration with an additional support member and the support surface assemblies removed to show details of the underlying shelf variable support platforms and the variable base.
Figure 13:
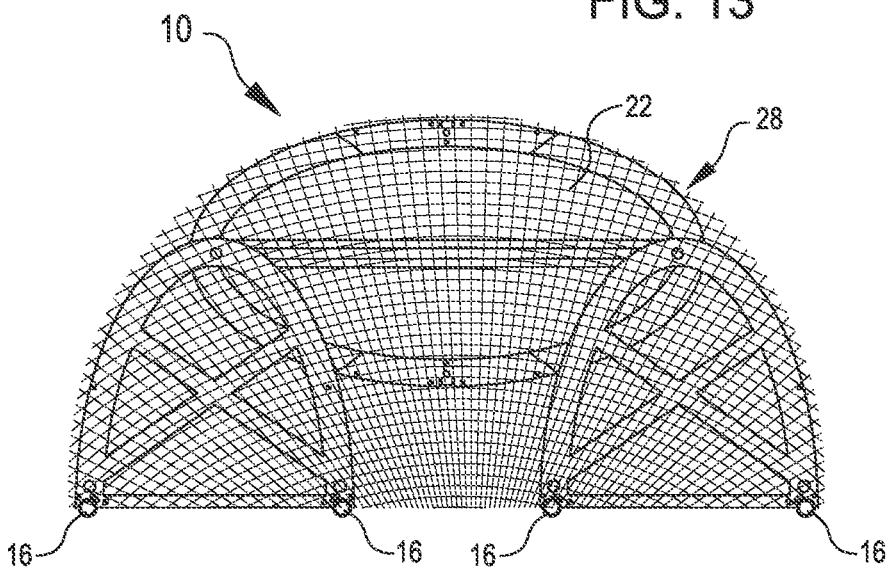
FIG. 13 is a top view of the variable-planform shelving system of FIG. 1 in the configuration of FIG. 12 with the support surface assemblies not removed and the additional support member not shown.

FIG. 12 shows the shelving system 10 (with the support surface assemblies 22 not shown) in another fully expanded curved configuration with a removable support column 70 added to provide additional support to the variable support platforms 28. In the configuration of FIG. 12, the support posts 16 are substantially aligned. In many embodiments, the connection between the support posts 16 and the variable support platforms 28 is configured to react mainly shear load. Accordingly, the removable support column 70 provides an additional support that is offset from the aligned support posts 16. With shear only connections between the variable support platforms 28 and the aligned support posts 16, the support column 70 provides required additional support to the variable support platforms 28. FIG. 13 shows the same configuration with the support surface assemblies 22 not removed and the support column 70 not shown. As can be seen, with shear load only type connections between the variable support platforms 28 and the aligned support posts 16, the support column 70 provides necessary offset support to the variable support platforms 28 to balance eccentricity between the items supported by the shelves and the aligned support posts 16.

Figure 14A:
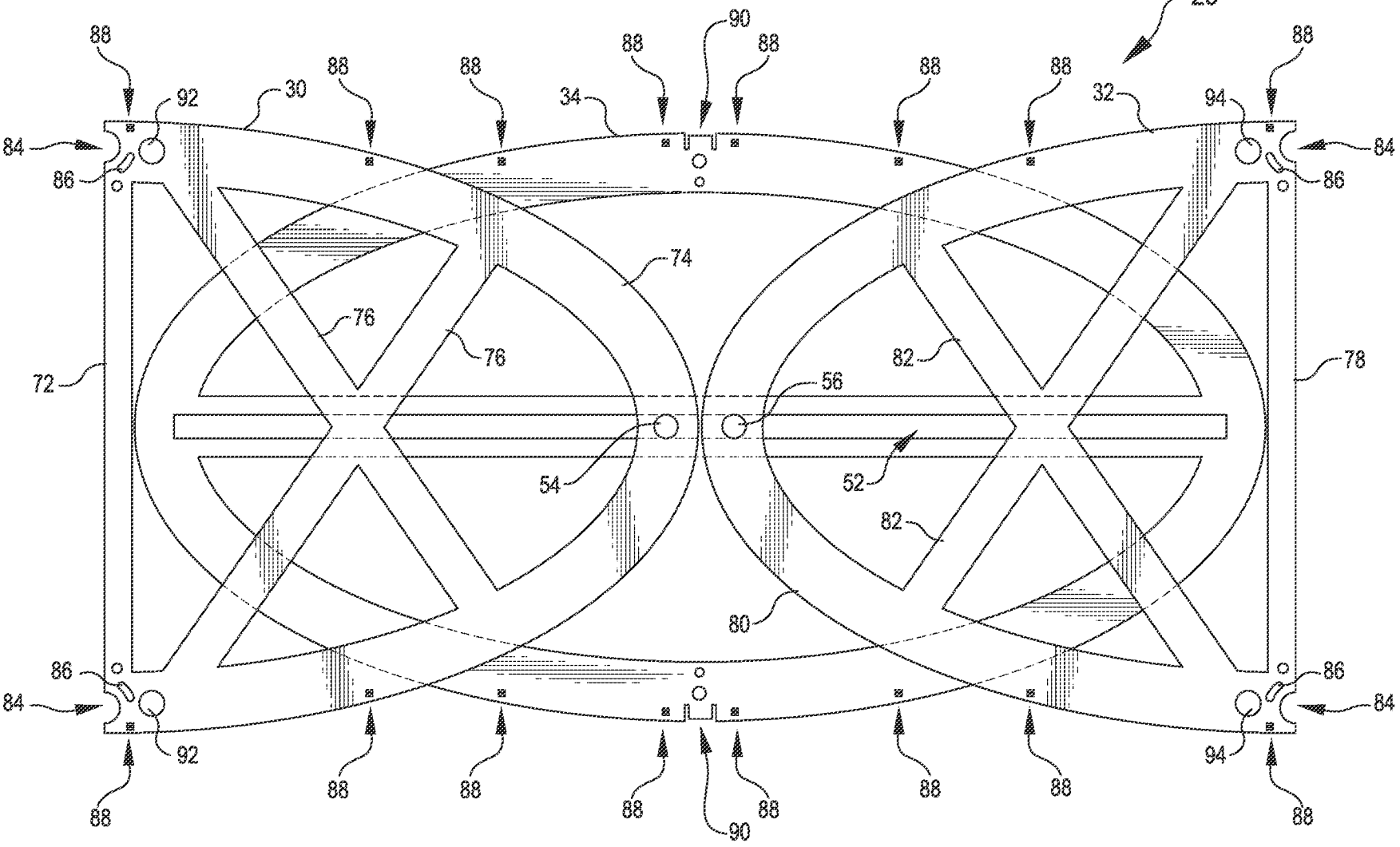
FIG. 14A is a plan view a variable support platform of the variable-planform shelving system of FIG. 1.

FIG. 14A shows a plan view of a variable support platform 28 in the compact collapsed configuration. The first frame 30 includes a straight base member 72, a half-elliptical perimeter member 74, and cross members 76. The perimeter member 74 and the cross members 76 are slotted so as to accommodate the illustrated end portion of the third frame 34. Likewise the second frame 32 includes a straight base member 78, a half-elliptical perimeter member 80, and cross members 82. The perimeter member 80 and the cross members 82 are slotted so as to accommodate the illustrated end portion of the third frame 34. At the corners of the first and second frames 30, 32, semi-circular recesses 84 are configured to accommodate the support posts 16. Adjacent to the semi-circular recesses 84, hanger apertures 86 are located to accommodate a portion of a supporting hanger bracket that is removably attached to one of the support posts 16. The hanger apertures 86 extend circumferentially around the recesses 84 for a limited extent so as to accommodate a suitable range of angular orientations of the support post 16 and the attached hanger bracket. The first, second, and third frames 30, 32, 34 include attachment apertures 88 that can be used to attach the price display assembly 20 shown in FIG. 1. And the third frame 34 includes attachment features 90 for the support column 70 shown in FIG. 12.

The central aperture 52 of the third frame 34 receives the coupling pins 54, 56, which are coupled with the first and second frames 30, 32 and extend across the slots in the first and second frames 30, 32, thereby extending through the central aperture 52. The central aperture 52 is configured to allow constrained movement of the third frame 34 relative to the first frame 30 and/or relative to the second frame 32, including changes in angular orientation of the third frame 34 relative to the first frame 30 and/or relative to the second frame 32.

The variable support platform 28 includes additional features that allows for its use as either the upper portion 36 of the base support platform 26 or the lower portion 38 of the base support platform 26. For example, the first frame 30 includes circular apertures 92 for the attachment of the column members 58 as shown in FIG. 4. The second frame 32 includes circular apertures 94 for the attachment of the column members 60. And the third frame 34 includes circular apertures 96 for the attachment of the column members 62.

Figure 14B:
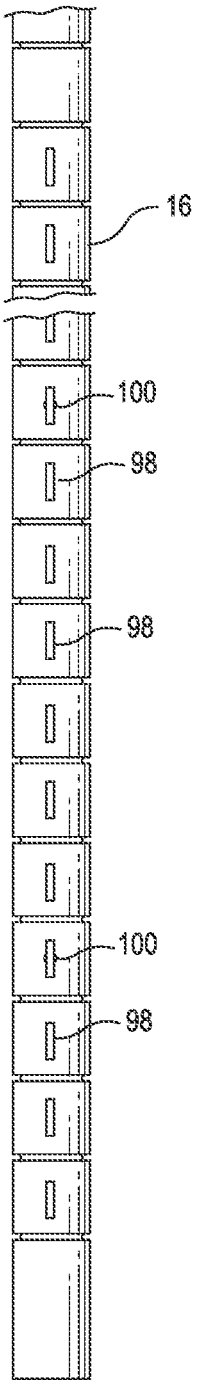
FIG. 14B is a fragmented, side view of a support post used in the variable-planform shelving system of FIG. 1.
Figure 14C:
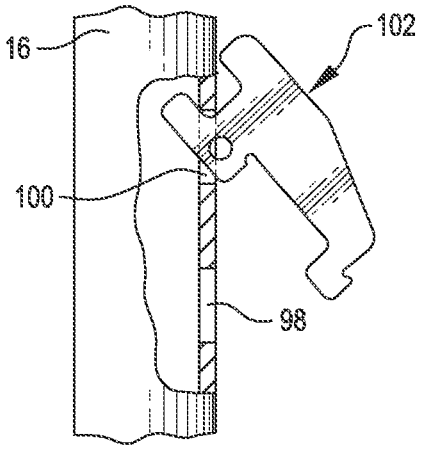
FIG. 14C is a fragmented, side view of a hanger bracket partially inserted in a first opening of a support post shown in FIG. 14B.
Figure 14D:
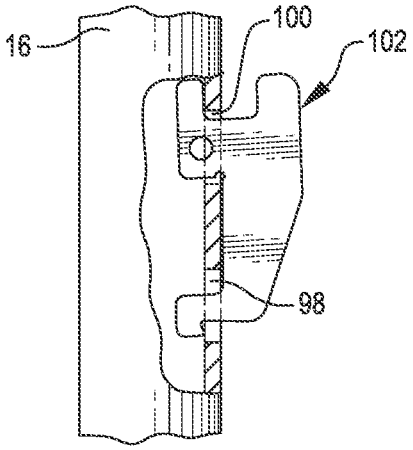
FIG. 14D is a fragmented, side view of a hanger bracket inserted in the first opening and a second opening of the support post shown in FIG. 14B resulting in a variable support platform supporting position.
Figure 14E:
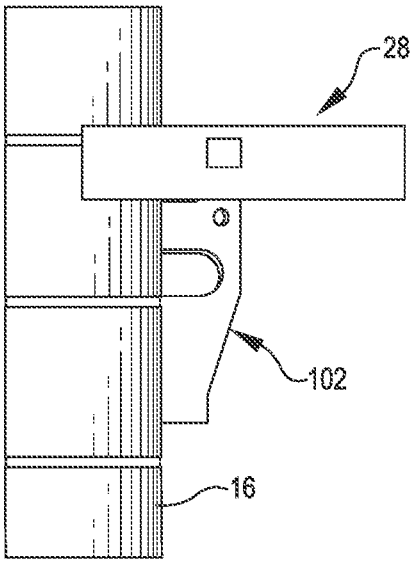
FIG. 14E is a side view of a hanger bracket attached to a support post and supporting a corner of a variable support platform of the variable-planform shelving system of FIG. 1.

FIG. 14B through FIG. 14E show details of how a variable support platform 28 is supported from one of the support posts 16. FIG. 14B shows bracket-receiving slots 98, 100 in the support posts 16. In many embodiments such as the one shown, the support posts 16 have a plurality of bracket-receiving slots at regular intervals, thereby providing for numerous combinations of numbers of shelves and/or spacing of shelves. FIG. 14C shows a hanger bracket 102 partially inserted in a first opening 100 of the support post 16. FIG. 14D shows the hanger bracket 102 attached to the support post 16. And FIG. 14E shows a close-up side view of the hanger bracket 102 attached to one of the support posts 16 and supporting a corner of a variable support platform 28. Additional details of a suitable approach for supporting the variable planform shelves 14 are described in U.S. Pat. No. 5,415,302, entitled "MODULAR SHELVING SYSTEM WITH A QUICK-CHANGE SHELF FEATURE," the entire disclosure of which is hereby incorporated by reference herein.

Figure 15:
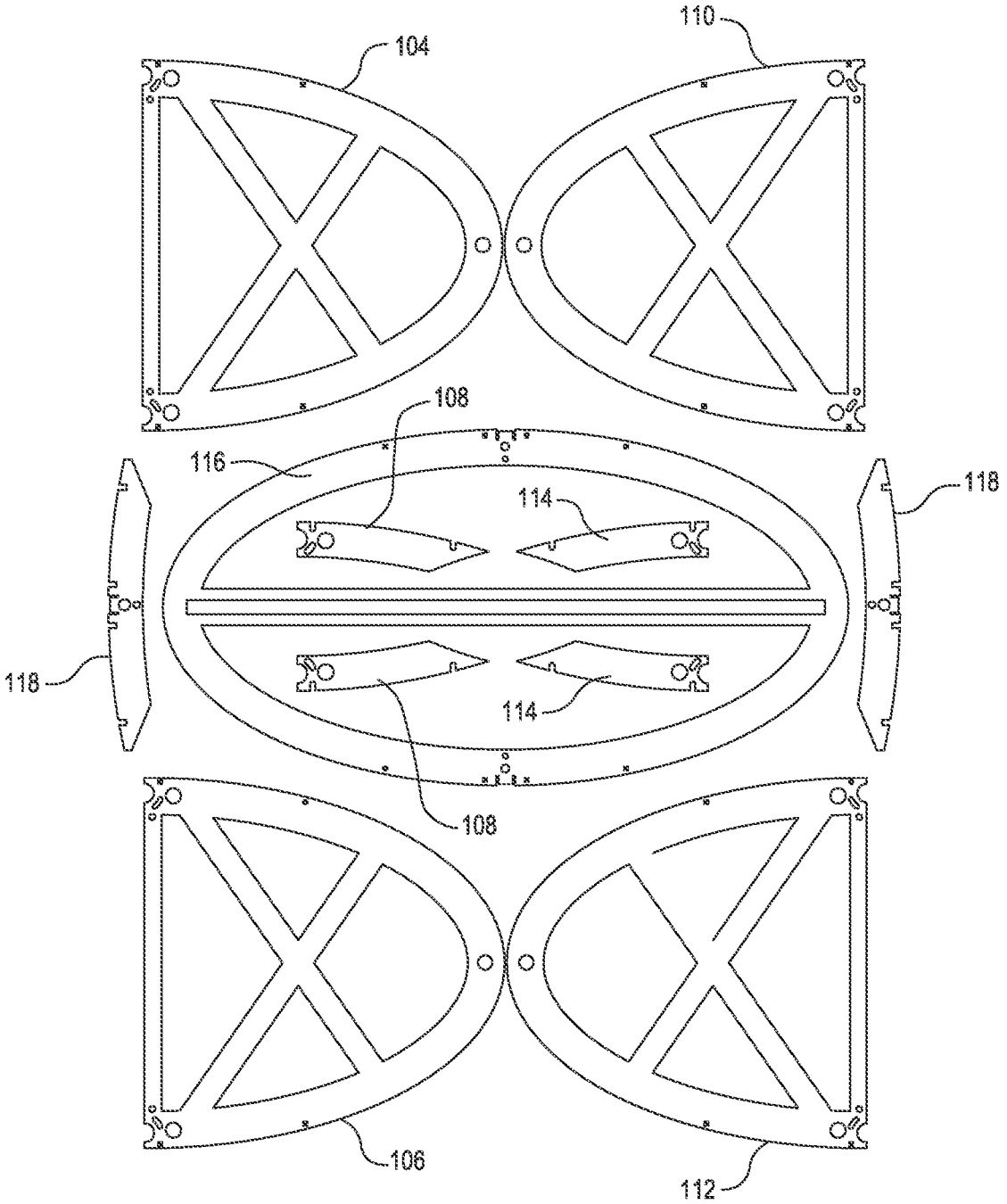
FIG. 15 is a plan view of components of frames of the variable support platform of FIG. 14A.

Any suitable fabrication method and material can be used to make the variable support platform 28. For example, in many embodiments, the first, second, and third frames 30, 32, 34 of the variable support platform 28 are made from components cut (e.g., using a water-jet) from a suitable constant thickness sheet of material. FIG. 15 shows a plan view of components that can be used to make the first, second, and third frames 30, 32, and 34 of the variable support platform 28. The first frame 30 can be made from a first upper component 104, a first lower component 106, and first spacer components 108. The first spacer components 108 are disposed between the first upper and first lower components 104, 106 so that the outer perimeter and common features of these components are aligned. The first spacer components 108 serve to separate the first upper and first lower components 104, 106 so as to form the slot that receives part of the third frame 34. In the same way, the second frame 32 can be made from a second upper component 110, a second lower component 112, and second spacer components 114. The second spacer components 114 are disposed between the second upper and second lower components 110, 112 so that the outer perimeter and common features of these components are aligned. The second spacer components 114 serve to separate the second upper and second lower components 110, 112 so as to form the slot that receives part of the third frame 34. The third frame 34 can be made from a third frame component 116 and third spacer components 118. The third spacer components 118 are disposed on top of the third frame component so that the outer perimeter and common features of these components are aligned. The third spacer components 118 provide an upper surface to the third frame 34 that is in plane with the upper surfaces of the first and second frames 30, 32. Any suitable method for joining the components can be used (e.g., bonding, welding, brazing, fastening).

Figure 16:
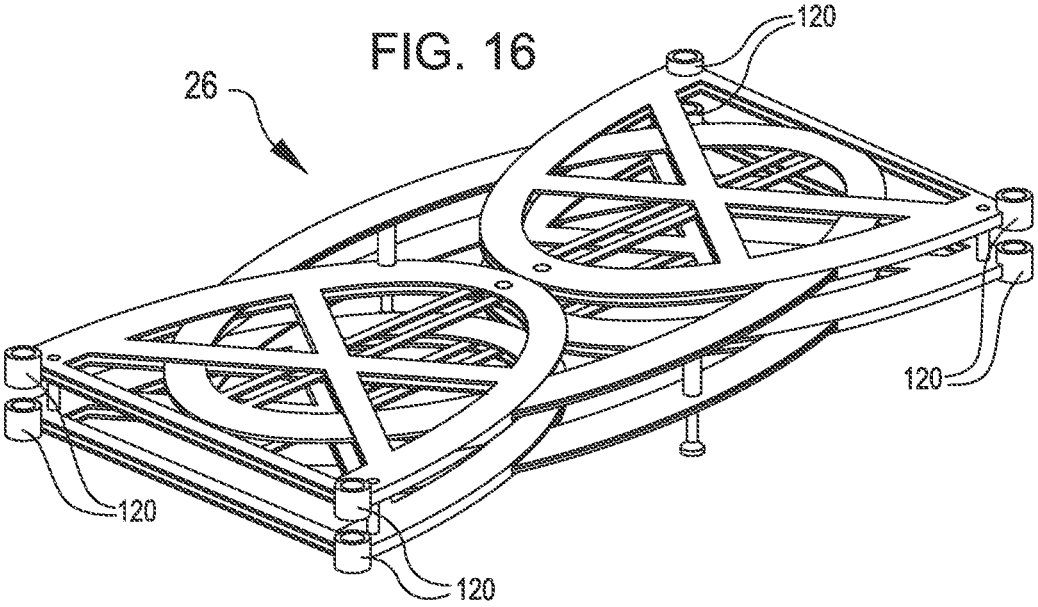
FIG. 16 is a perspective view of a variable base assembly of the variable-planform shelving system of FIG. 1 in the compact collapsed configuration of FIG. 1 with the associated support surface assembly removed to show details of the variable base assembly.

Additional details of the variable support base 26 will now be described with references to FIG. 16. The variable support base 26 includes two cylindrical sleeves 120 at each corner. The sleeves 120 interface with the support posts 16 and rigidly tie the support posts to the variable support base 16, thereby stiffening the shelving system 10 against lateral deflection of the shelves 14 relative to the variable support base 26.

Figure 17:
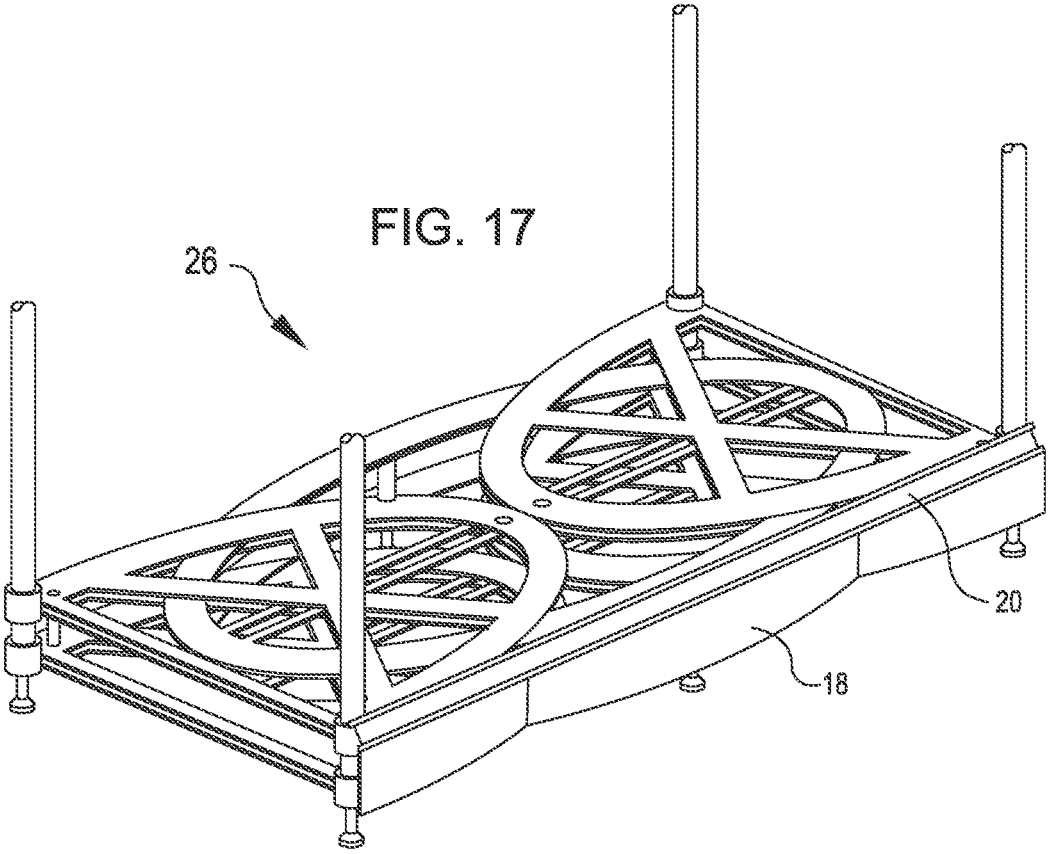
FIG. 17 is a perspective view of a kick plate assembly and a price display assembly of the variable-planform shelving system of FIG. 1.
Figure 18:
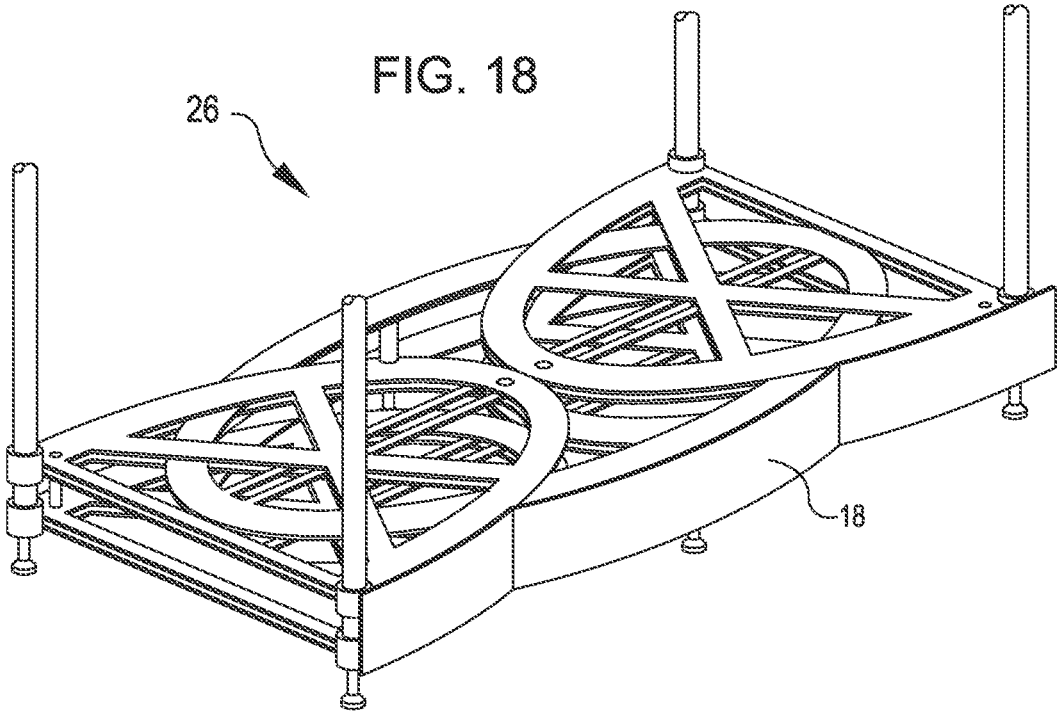
FIG. 18 is a perspective view of the kick plate assembly of FIG. 17 with the price display assembly removed.

Details of the kick plate assembly 18 and the price display assembly 20 will now be described with reference to FIG. 17 through FIG. 28. Both the kick plate assembly 18 and the price display assembly 20 are configured to expand and conform to all of the possible planform configurations of the base support platform 26. FIG. 17 shows the kick plate assembly 18 and the price display assembly 20 attached to the base support platform 26 in the compact collapsed configuration. FIG. 18 shows the kick plate assembly 18 attached to the base support platform 26 with the price display assembly 20 not shown.

Figure 19:
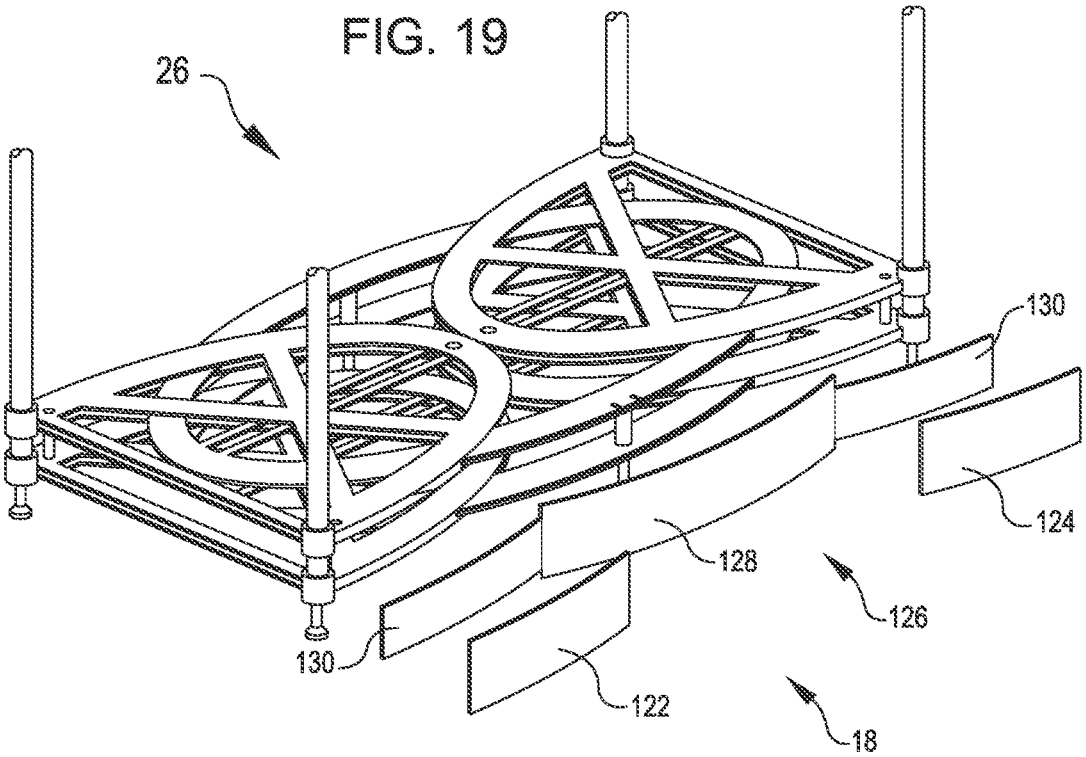
FIG. 19 is an exploded perspective view of the kick plate assembly of FIG. 17.

FIG. 19 shows an exploded perspective view of the kick plate assembly 18. The kick plate assembly 18 includes a first kick plate segment 122, a second kick plate segment 124, and a third kick plate segment 126. The first kick plate segment 122 attaches to the first upper and first lower frames 40, 46 of the base support platform 26. The second kick plate segment 124 attaches to the second upper and second lower frames 42, 48 of the base support platform 26. And the third kick plate segment 126 attaches to the third upper and third lower frames 44, 50 of the base support platform 26. The first and second kick plate segments 122, 124 have thin rectangular bodies and can be made to be flexible or inflexible. The first and second kick plate segments 122, 124 cover fixed regions of the base support platform 26 corresponding to forward facing exposed edges of the first upper and first lower frames 40, 46 and of the second upper and second lower frames 42, 48, respectively. The third kick plate segment 126 includes a central portion 128 and side extensions 130. The central portion 128 covers a fixed region of the base support platform 26 corresponding to forward facing exposed edges of the third upper and third lower frames 44, 50. When the base support platform 26 is in the compact collapsed configuration (as shown), the side extensions extend behind and are fully covered by the first and second kick plate segments 122, 124. When the base support platform 26 is in an expanded configuration, the side extensions cover forward facing portions of the base support platform 26 disposed between the central portion 128 and each of the first and second kick plate segments 122, 124. The third kick plate segment 126 can be made suitably flexible such that the side extensions are able to conform to all of the various planform configurations of the base support platform 26.

Additional features of the kick plate assembly 18 are shown in FIG. 20 through FIG. 22. FIG. 20 is a rear perspective view showing a portion of the first kick plate segment 122 and a portion of the third kick plate segment 126. FIG. 21 is a rear perspective view showing a portion of the second kick plate segment 124 and a portion of the third kick plate segment 126. Each of the first, second, and third kick plate segments 122, 124, 126 have barbed attachment features 132 that extend rearward from the aft face of the segment. The barbed attachment features 132 are sized and configured to be accommodated by and engage with the attachment apertures 88 (as shown in FIG. 14A) in the base support platform 26 so as to attach the kick plate assemblies 122, 124, 126 to the base support platform 26. The attachment features 132 in the first and second kick plate segments 122, 124 are located to accommodate and optionally support the side extensions 130 of the third kick plate segment 126 there between. FIG. 22 shows the kick plate assembly 18 in an expanded configuration and illustrates the coverage provided by the side extensions 130.

Figure 23:
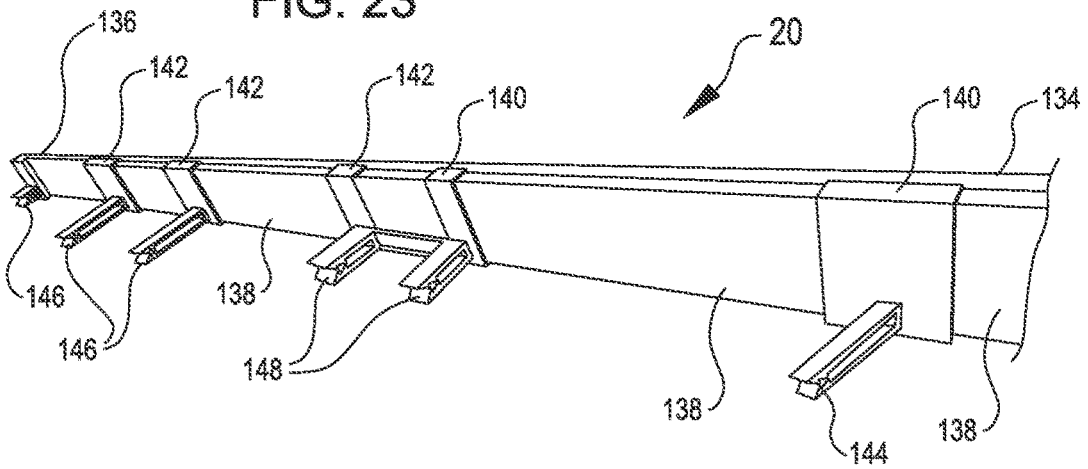
FIG. 23 through FIG. 25 are perspective views of the price display assembly of FIG. 17 in the compact collapsed configuration of FIG. 1.
Figure 24:
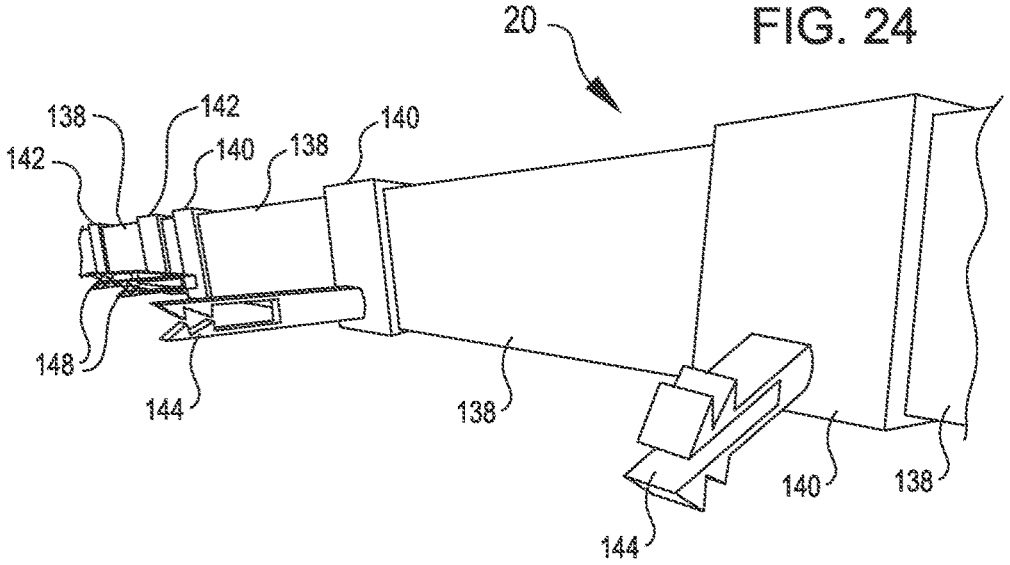
Figure 25:
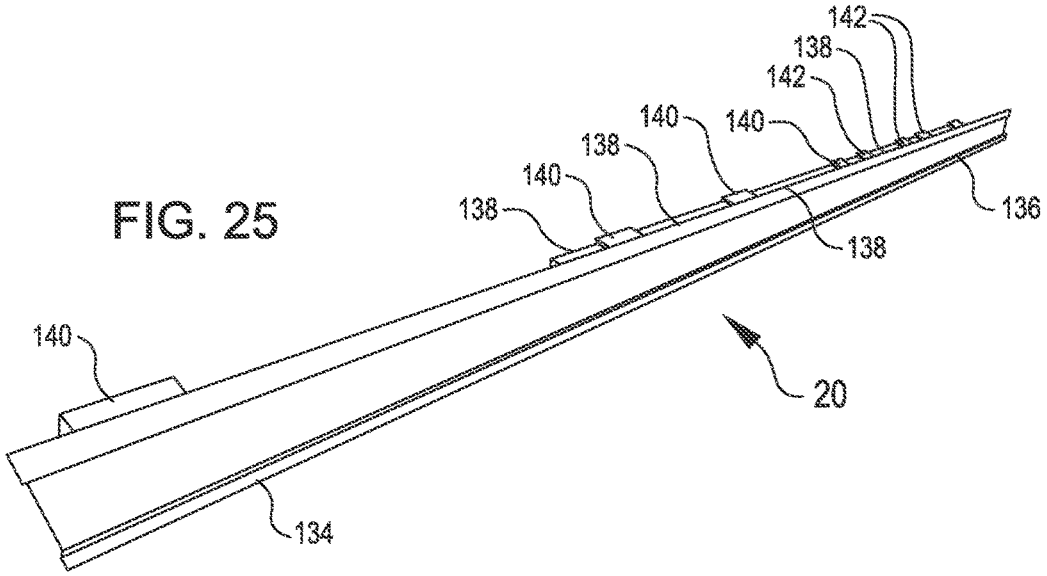
Figure 26:
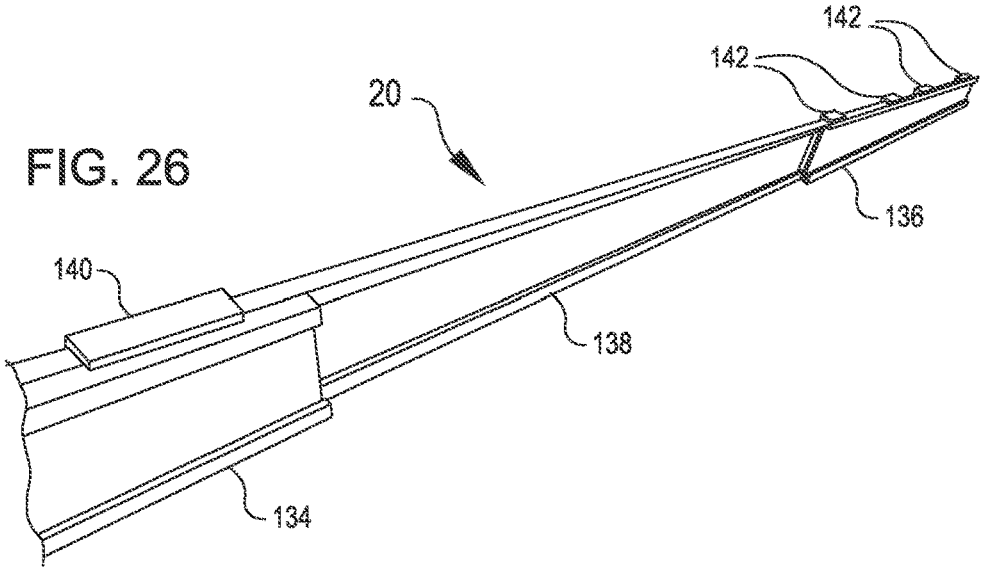
FIG. 26 is a perspective view of the price display assembly of FIG. 17 in an expanded configuration.
Figure 27:
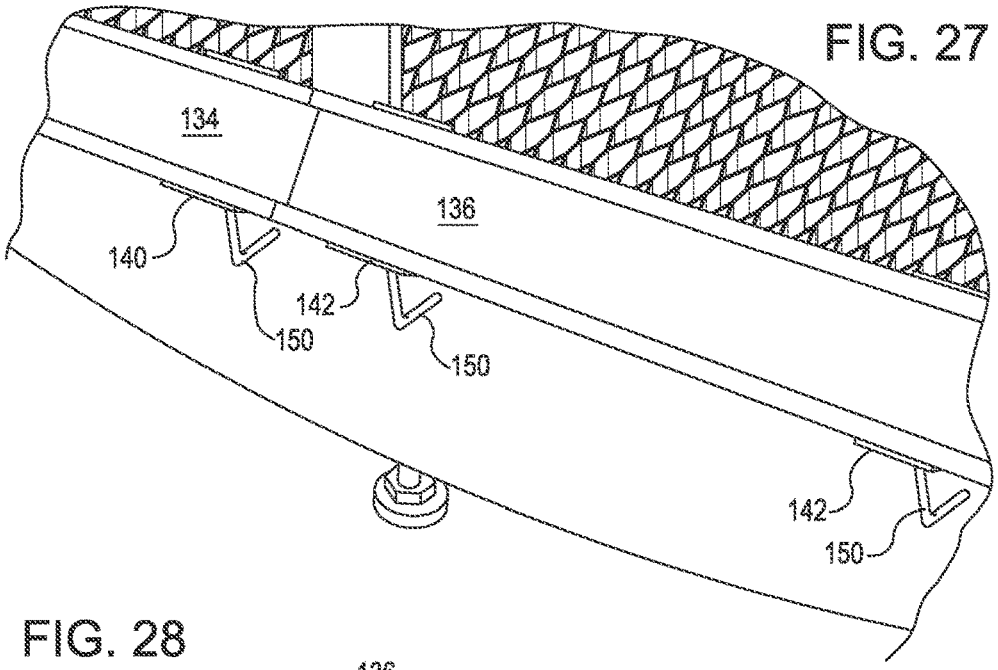
FIG. 27 and FIG. 28 are close-up perspective views showing details of the variable-planform shelving system of FIG. 1 in the compact collapsed configuration of FIG. 1.
Figure 28:
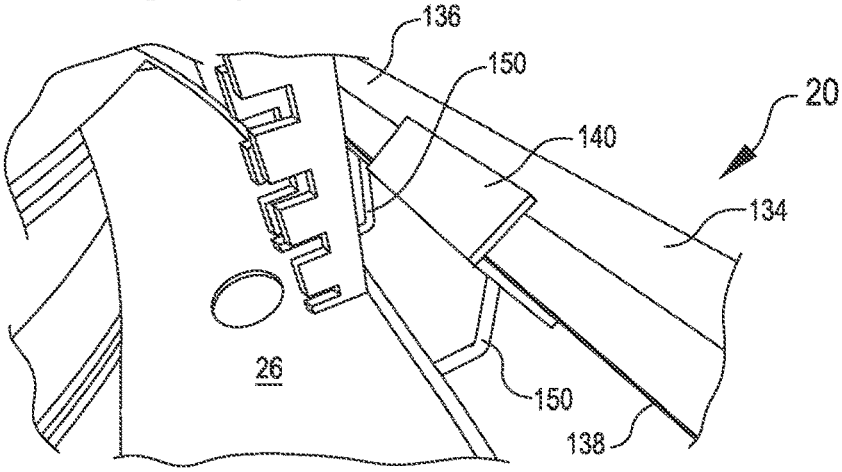

FIG. 23 through FIG. 28 show details of the price display assembly 20, in accordance with many embodiments. FIG. 23 and FIG. 24 show rear perspective views of an embodiment of the price display assembly 20 that is configured to attach to the attachment apertures 88 (as shown in FIG. 14A) in the variable support platform 28. FIG. 25 shows a front perspective view of the price display assembly 20. The price display assembly 20 includes a first display segment 134, a second display segment 136, and a flexible third display segment 138 that is slidably received through rectangular frame portions 140, 142 of the first and second display segments 134, 136, respectively. The first display segment 134 includes barbed attachment features 144 that extend rearward from the aft face of the first display segment 134. The second display segment 136 includes barbed attachment features 146 that extend rearward from the aft face of the second display segment 136. And the third display segment 138 includes barbed attachment features 148 that extend rearward from the aft face of the third display segment 138. The attachment features 144, 146, 148 are sized and configured to be accommodated by and engage with the attachment apertures 88 (as shown in FIG. 14A) in the variable support platform 28 so as to attach the price display assembly 20 to the variable support platform 28. The first display segment 134 is attached to the first frame 30; the second display segment 136 is attached to the second frame 32; and the third display segment 138 is attached to the third frame 34. When the variable support platform 28 is reconfigured, the flexible third display segment 138 slides relative to the first display segment 134 and/or relative to the second display segment 136 through the rectangular frame portions 140, 142 of the first and second display segments 134, 136, while still remaining engaged through at least one of the rectangular frame portions 140, 142 in each of the first and second display segments 134, 136. Any misalignment between the first and second display segments 134, 136 is accommodated by flexure of the flexible third display segment 138. FIG. 26 shows the price display assembly 20 in an expanded configuration and illustrates the price display coverage provided by the third display segment 138 between the first and second display segment 134, 136. FIG. 27 and FIG. 28 show an embodiment of the price display assembly 20 configured to be mounted to the base support platform 26 via support beams 150 extending from the rectangular frame portions 140, 142.

Figure 29:
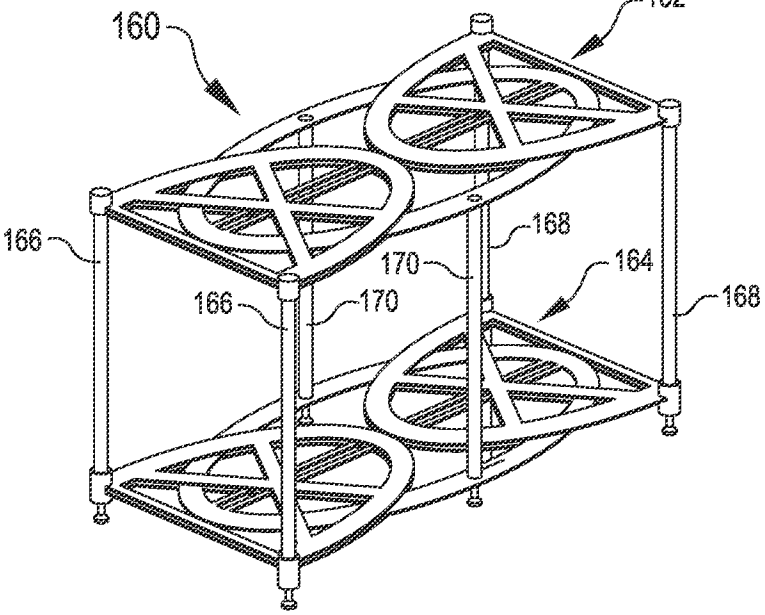
FIG. 29 is a perspective view of a table having a variable planform with a support surface assembly removed to better show underlying details, in accordance with many embodiments.

FIG. 29 shows a variable planform table 160 with a support surface assembly removed to better show underlying details, in accordance with many embodiments. The table 160 includes a variable support platform 162; a variable base 164; first intermediate members 166, second intermediate members 168 and third intermediate members 170. The variable support platform 162 and the variable base 164 are configured similar to the variable support platform 28 described herein. In many embodiments, the table 160 includes a support surface assembly 22 (not shown) supported by the variable support platform 162. And in many embodiments, the table 160 includes a support surface assembly 22 (not shown) supported by the variable base 164. In similar manner to the variable shelving system 10 described herein, the table 160 can be reconfigured into different planforms having different sizes and shapes.

Figure 30:
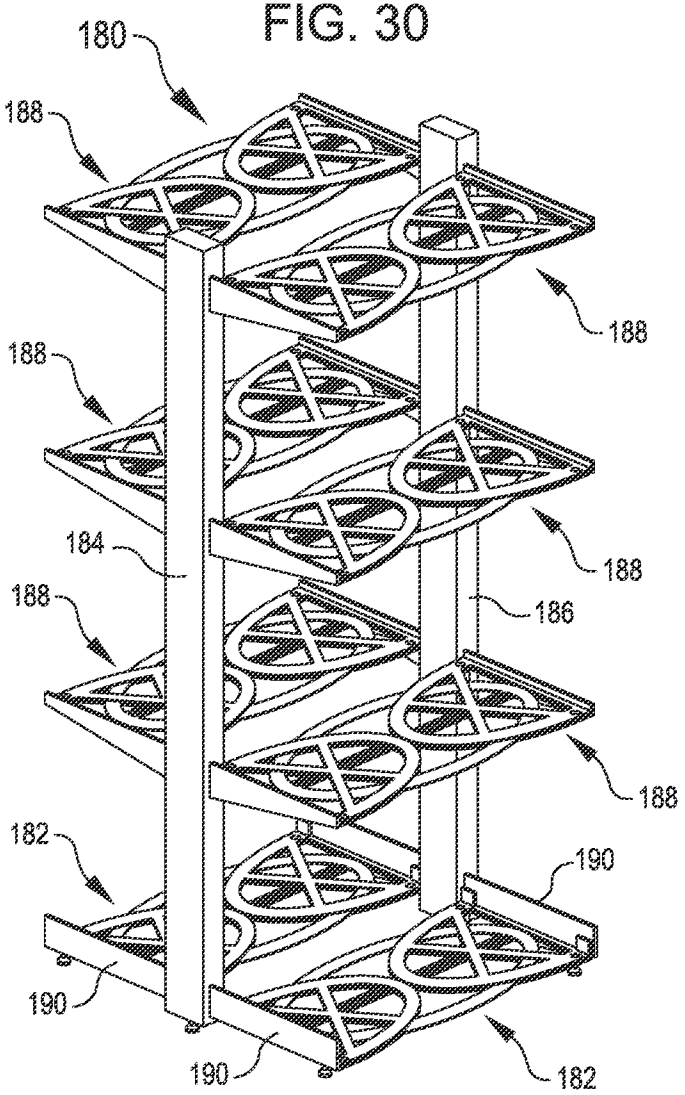
FIG. 30 is a perspective view of another variable-planform shelving system in a compact collapsed configuration with support surface assemblies removed to better show underlying details, in accordance with many embodiments.
Figure 31:
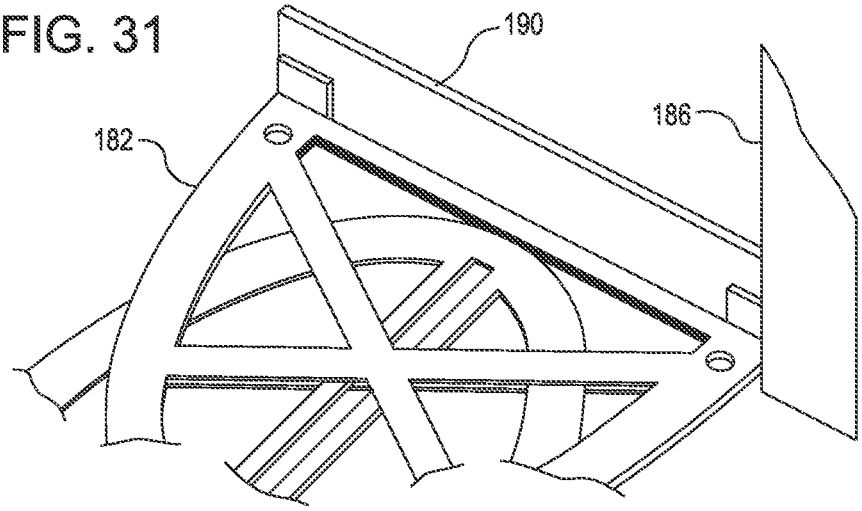
FIG. 31 is a close-up perspective view showing details of a base support platform of the variable-planform shelving system of FIG. 30.
Figure 32:
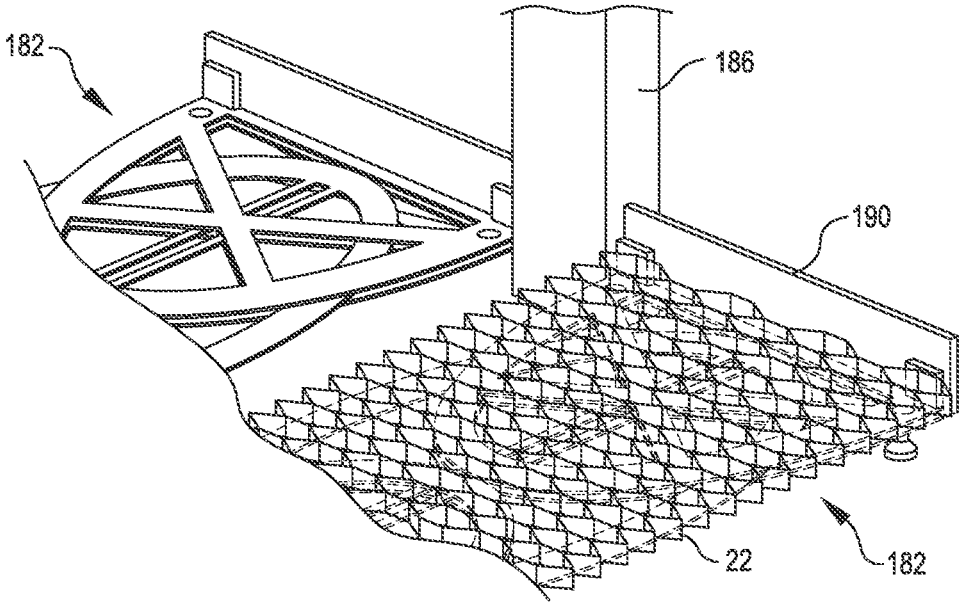
FIG. 32 is a close-up perspective view showing details of a support surface assembly of the variable-planform shelving system of FIG. 30.
Figure 33:
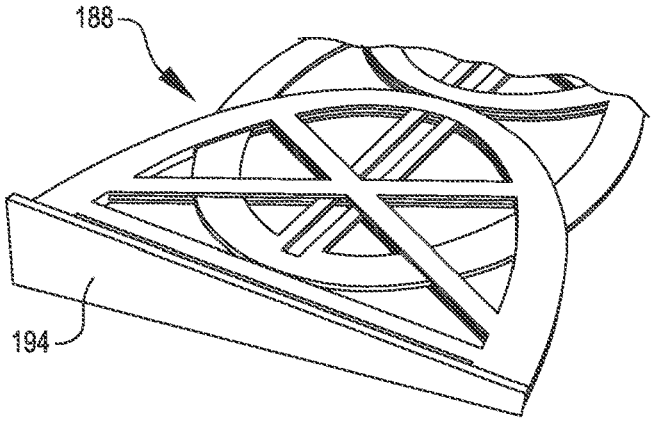
FIG. 33 is a close-up perspective view showing details of a variable support platform of the variable-planform shelving system of FIG. 30.

FIG. 30 shows another variable-planform shelving system 180, in accordance with many embodiments, in a compact collapsed configuration with support surface assemblies 22 removed to better show details of underlying features. The shelving system 180 includes base support platforms 182 and opposing support columns 184, 186 with variable support platforms 188 supported there from. The base support platforms 182 and the variable support platforms 188 are configured similar to the variable support platforms 28. FIG. 31 is a close-up perspective view showing connection details between a base support platform 182 and a base beam 190 rigidly attached to each of the support columns 184, 186. End frames of the base support platform 182 includes flanges 192 that are bolted to the base beam 190, thereby rigidly connecting the base support platform to the support columns 184, 186. FIG. 32 shows a support surface assembly 22 coupled to and supported by one of the base support platforms 182. FIG. 33 shows a close-up view of an end of one of the variable support platforms 188, which includes an integral end support beam 194. Each of the end support beams 194 is attached to and cantilevered from one of the support columns 184, 186.

Figure 34:
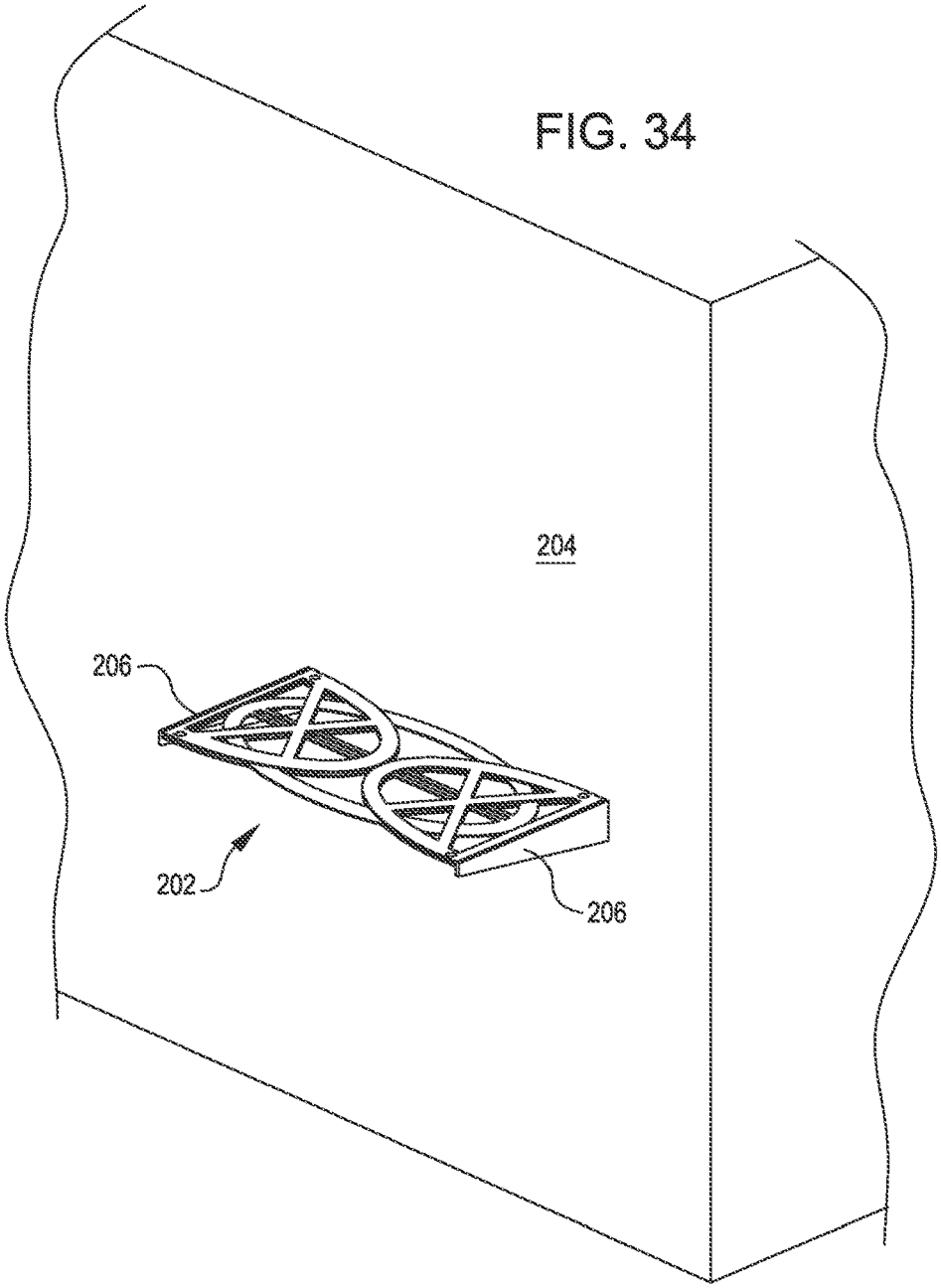
FIG. 34 is a perspective view of a variable support platform of a wall-mounted variable-planform shelf in a compact collapsed configuration, in accordance with many embodiments.
Figure 35:
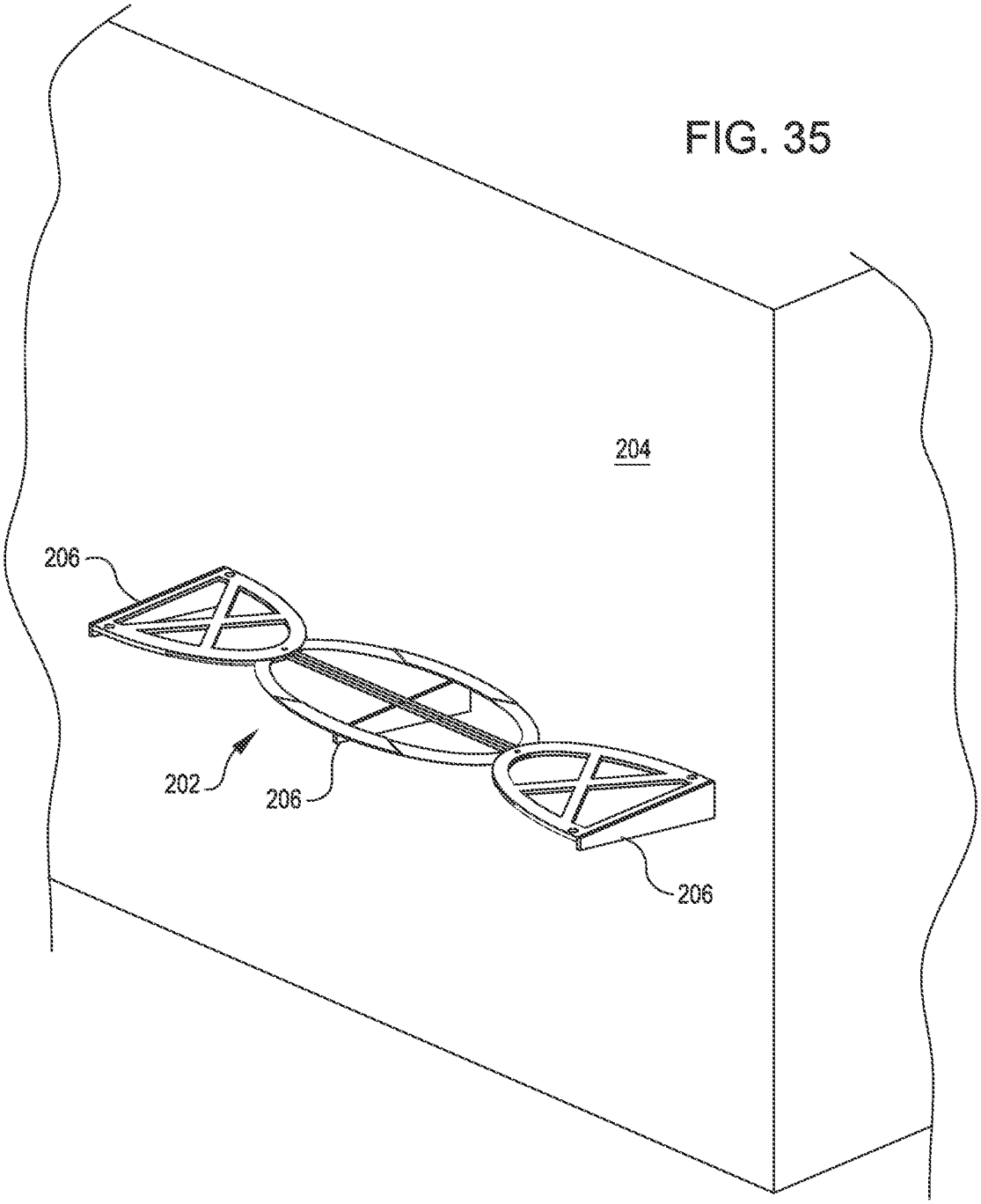
FIG. 35 is a perspective view of the variable support platform of FIG. 34 in an expanded configuration.
Figure 36:
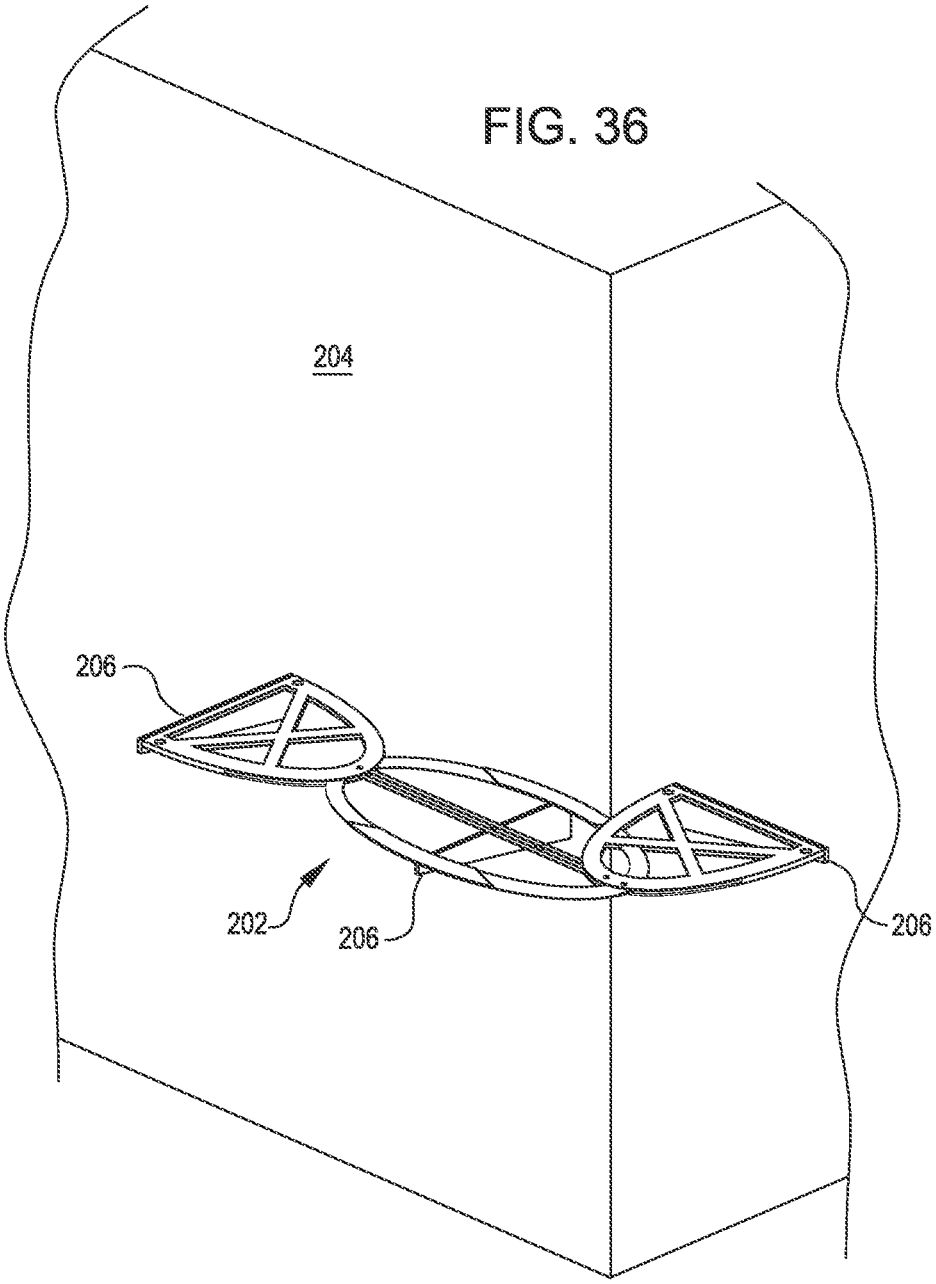
FIG. 36 is a perspective view of the variable support platform of FIG. 34 in an expanded configuration that wraps around an exterior corner of a wall.
Figure 37:
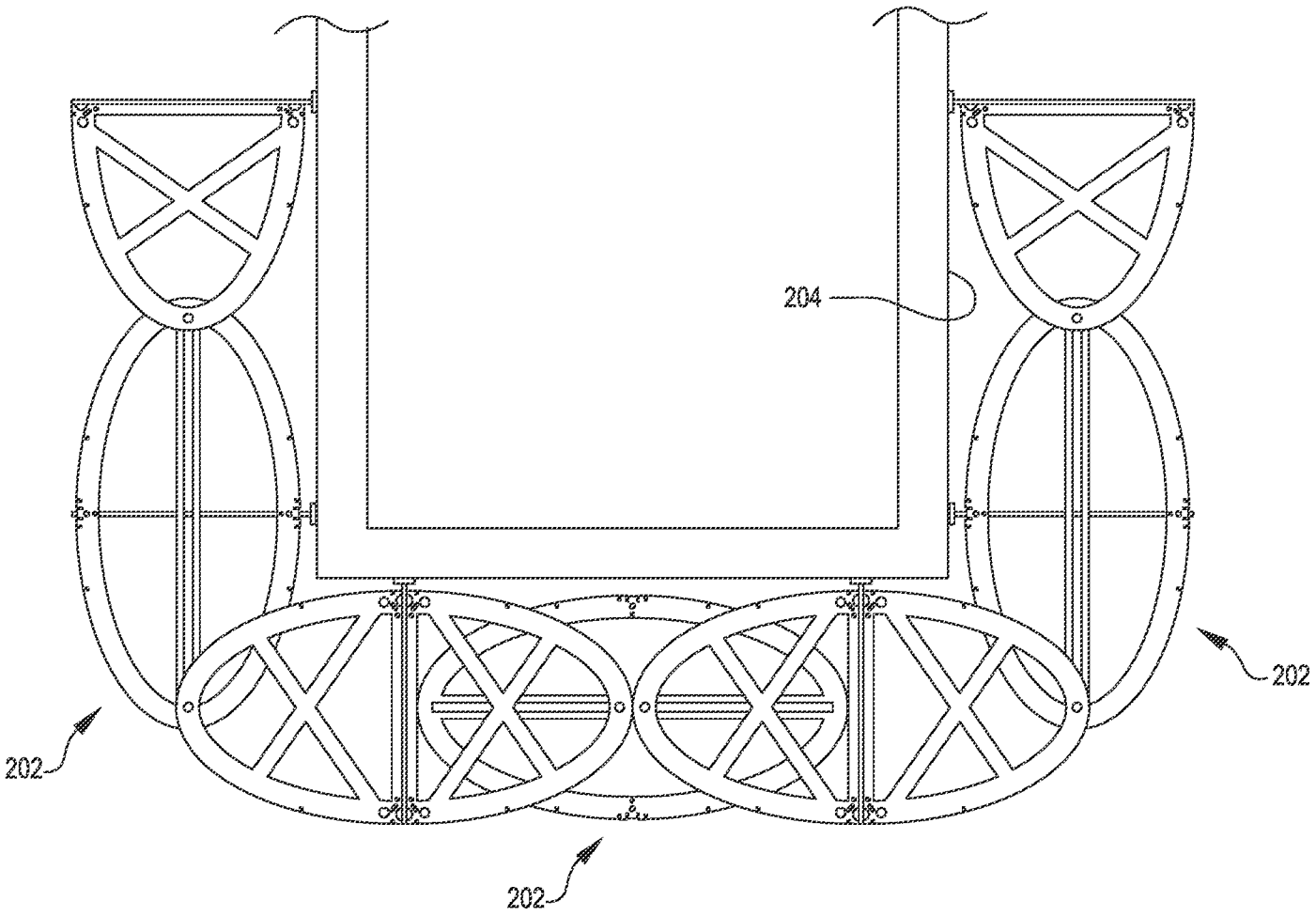
FIG. 37 is a plan view showing three variable support platforms of FIG. 34 installed to wrap around two exterior corners of a wall.

FIG. 34 through FIG. 36 show a wall-mounted variable-planform shelving system 200, in accordance with many embodiments. The shelving system 200 includes variable support platforms 202 that are configured similar to the variable support platforms 188. Each of the variable support platforms is attachable to a wall 204 via two or more support beams 206. For example, FIG. 34 shows a single variable support platform 202 in a compact collapsed configuration attached to the wall 204 via two support beams 206 disposed at opposing ends of the variable support platform 202. FIG. 35 shows a single variable support platform 202 in a fully-expanded configuration attached to the wall 204 via three support beams 206. FIG. 36 shows a single variable support platform 202 in a fully-expanded configuration that wraps around a corner of the wall 204. And FIG. 37 shows three variable support platforms 202 that wrap around two corners of the wall 204. As can be appreciated, the wall-mounted variable-planform shelving system 200 can be used and/or adapted for use with numerous wall configurations having different lengths, external corners, and/or internal corners.

Figure 38A:
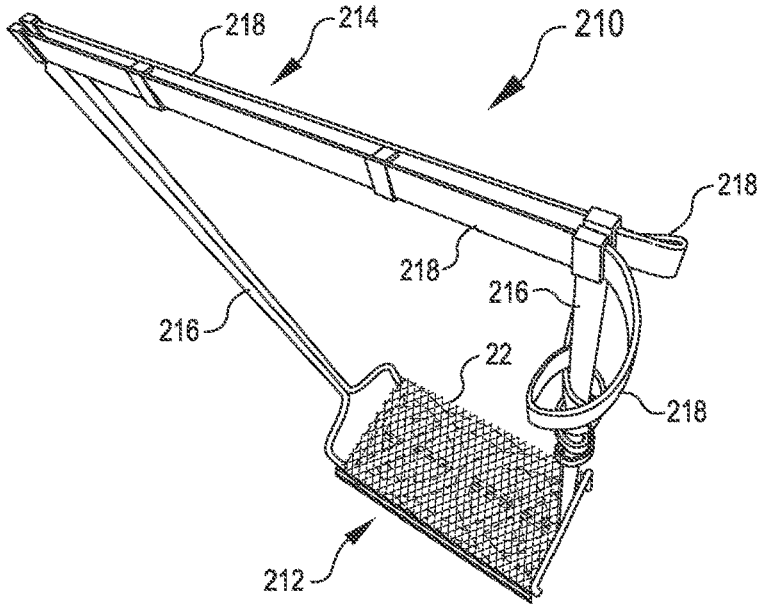
FIG. 38A and FIG. 38B are perspective views of a variable-length clothes rack having a variable-planform base, in accordance with many embodiments.
Figure 38B:
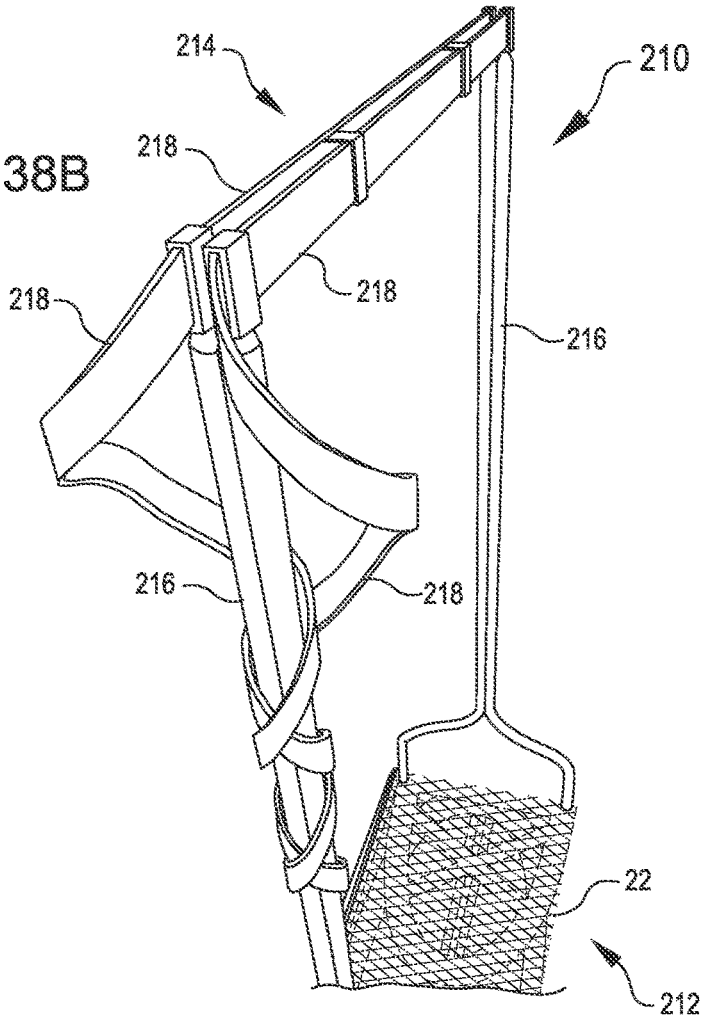

FIG. 38A and FIG. 38B show a variable-length clothes rack 210 having a variable-planform base 212, in accordance with many embodiments. The variable planform base 212 is configured similar to the variable planform base 12 described herein. Supported from the variable planform base 212 is an extendable top beam 214 from which clothes can be hung. The extendable top beam 214 can be reconfigured to various lengths corresponding to the various possible planforms of the variable planform base 212. The extendable top beam 214 is supported by two support columns 216, which are rigidly connected to opposing ends of the variable planform base 212. The extendable top beam 214 includes two flexible strap members 218, segments of which are held in tension between the tops of the support columns 216. For example, ends of the strap members 218 can be attached to the top of one of the support columns 216 and an intermediate location of each of the strap members 218 can be clamped to the top of the opposing support column 216 to maintain the tension in the strap members 218 between the tops of the support columns 216. As shown, the variable planform base 212 includes a support surface assembly 22 that can be used to support additional items (e.g., shoes, boots, etc.).

Figure 39A:
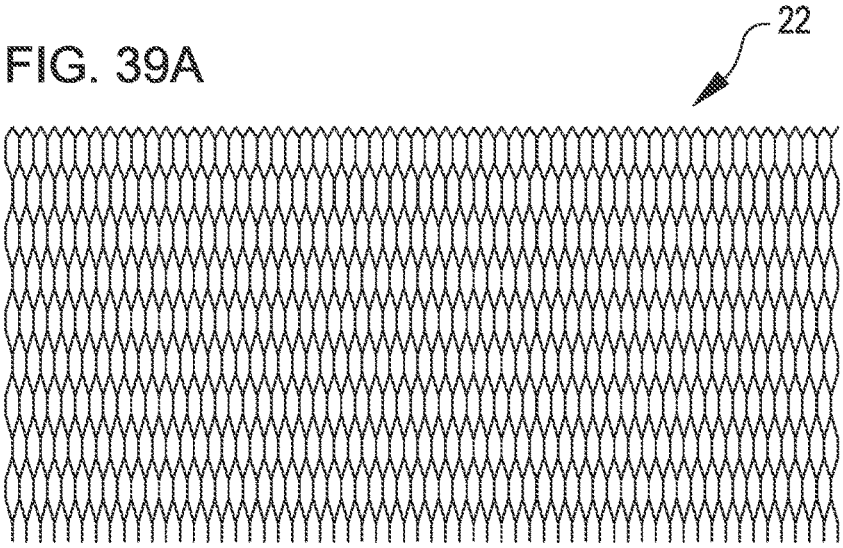
FIG. 39A is a plan view of a support surface assembly in an intermediate length configuration, in accordance with many embodiments.
Figure 39B:
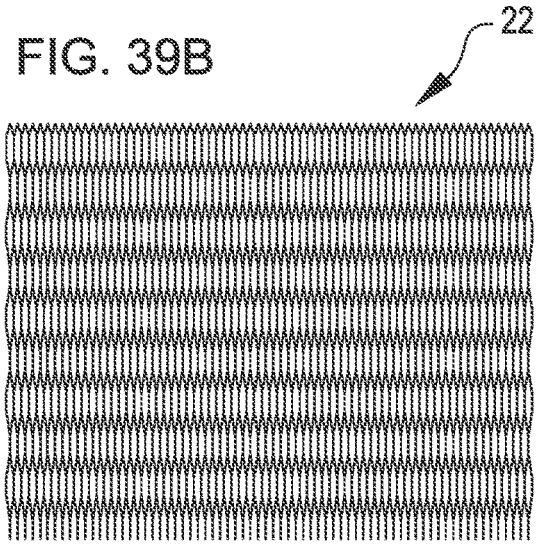
FIG. 39B is a plan view of the support surface assembly of FIG. 39A in a collapsed compact length configuration.
Figure 39C:
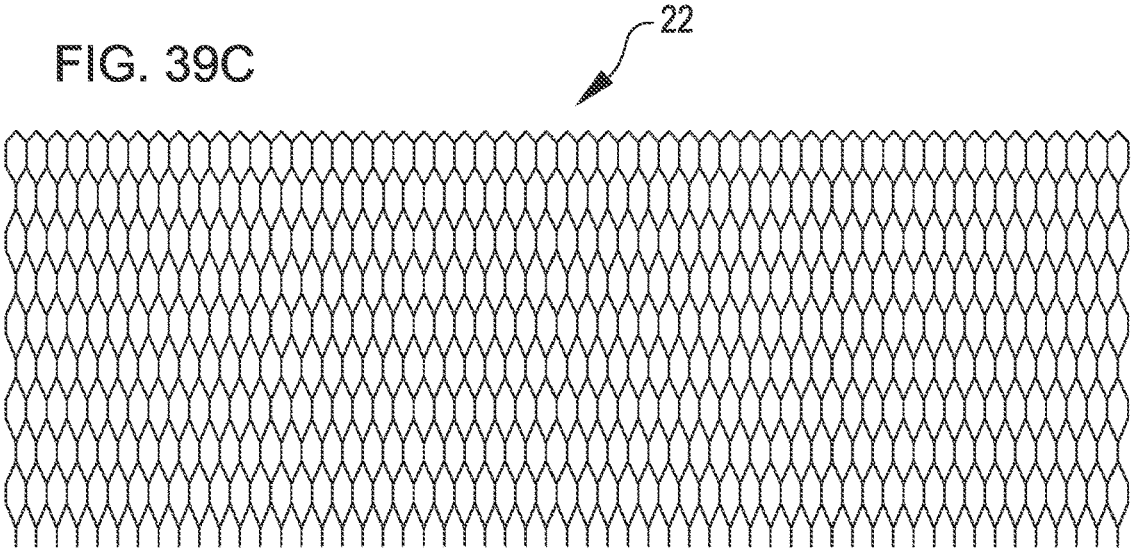
FIG. 39C is a close-plan view of the support surface assembly of FIG. 39A in an expanded length configuration.

FIGS. 39A, 39B, and 39C show plan views of the support surface assembly 22 in different expanded states. FIG. 39A shows the support surface assembly 22 in an intermediate length state corresponding to an intermediate length of the support surface assembly 22. The support surface assembly 22 is made from a plurality of flat panel members that extend vertically relative to view direction shown and are intermittently bonded together to a flexible and expandable assembly. FIG. 39B shows the support surface assembly 22 in a compressed state corresponding to a reduced length of the support surface assembly 22 in which the separation distance between adjacent flat panel members is reduced. And FIG. 39C shows the support surface assembly 22 in an expanded state corresponding to a maximum length of the support surface assembly 22. By using a suitable number of flat panel members, the distance between adjacent flat panel members at locations between bonded areas can be kept below a distance suitable for ensuring that the support surface assembly 22 does not contract to a detrimental extent transverse to the expansion direction of the support surface assembly 22 when the support surface assembly 22 is expanded.

Any suitable material can be used to fabricate the support surface assembly 22. For example, the support surface assembly 22 can be made from polycarbonate strips, acrylic strips, and acrylic abrasion resistant strips. In general, the strips are flexible, and have a resiliency to return to their straight configuration. As can be seen in FIGS. 39A-39C, and in FIG. 32, adjacent strips are glued or otherwise attached to each other so that, when the support surface assembly 22 is elongated, the strips each pulled at intermediate connection points into a sine wave shape. To provide this function, first and second adjacent strips are attached at regular intervals along their length. A third strip, on the opposite side of the second strip from the first strip, is attached to the first strip at intermediate connection points to the first strip. These intermediate connection points are between the connection points of the first strip and the second strip, for example half way between the connection points. This pattern is repeated throughout the support surface assembly 22. In this manner, when ends of the support surface assembly 22 are pulled apart, each of the strips is pulled into a sine wave shape.

In addition to being flexible, the strips preferably have enough compressive strength, especially in the height direction, to support objects on the support surface assembly 22 without collapse of individual strips or the overall structure. The above materials are examples of materials that work well for this purpose, and in embodiments, 1/32 inch polycarbonate strips are used and provide this function. Such strips, in an embodiment, are attached so as to form 1.5 inch long diamonds in the pattern. That is, the intermediate connection points on the strips are space 1.5 inches each.

Any suitable method of manufacturing the support surface assembly 22 can be used. For example, separate strips can be joined via a suitable method (e.g., fusing, liquid welding, gluing). A form can be used to hold separate strips while they are joined. And the support surface assembly 22 can be fabricated by pouring a suitable material into a mold.

Any suitable fabrication method and material can be used to make the variable-planform shelving systems, tables, and clothes racks described herein. For example, suitable materials include steel, stainless steel, aluminum, galvanized steel, zinc, iron, titanium, and plastics (e.g., polycarbonate, acrylic, ABS, and HDPE). Suitable fabrication methods include, for example, stamping, water jetting, pouring, forming, metal casting, CNC machining, casting, and injection molding.

Figure 40:
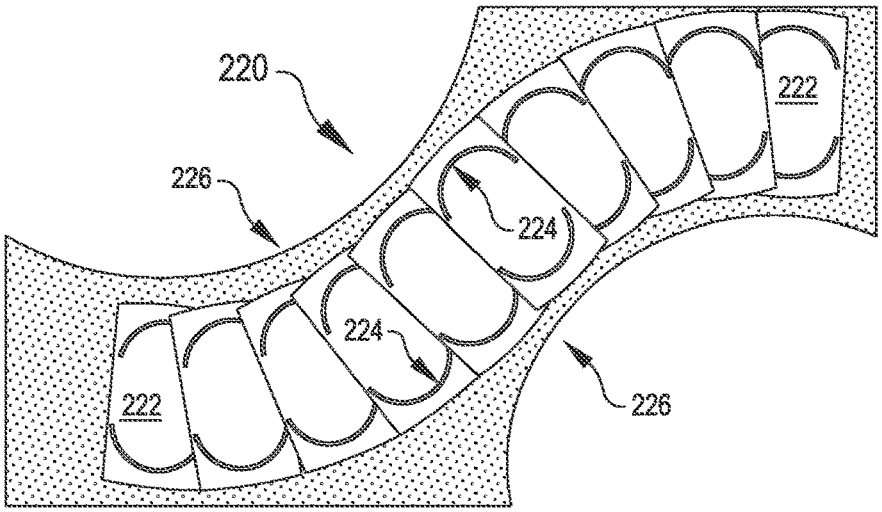
FIG. 40 is a plan view of a support surface assembly that includes overlapping coupled panels, in accordance with many embodiments.
Figure 41:
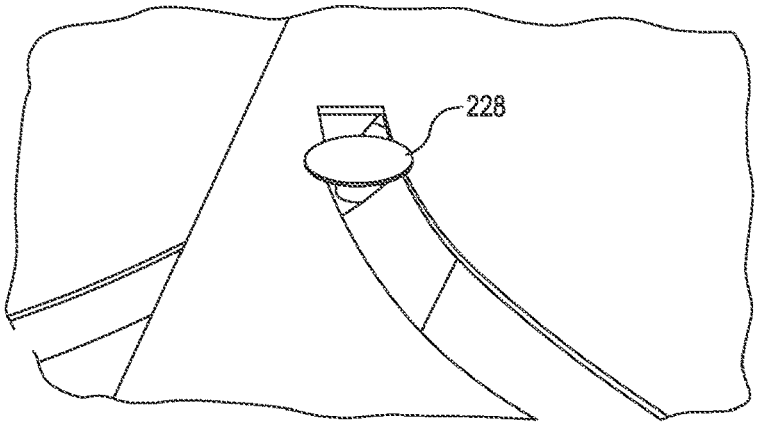
FIG. 41 is a close-up perspective view of a coupling feature that interfaces with slots in adjacent panels of the support surface assembly of FIG. 40.

FIG. 40 shows a support surface assembly 220 that can be used in place of the support surface assembly 22. The support surface assembly 220 includes a plurality of slotted panels 222 having slots 224. Each of the slotted panels has a substantially rectangular planform with slightly curved outer edges 226 so as to present a smooth combined edge when the support surface assembly 220 is shaped to have a curved planform such as shown in FIG. 40. Each of the slots 224 is shaped to overlap an adjacent slot 224 of an adjacent panel in each of the various planform configurations of the support surface assembly 220. At each of the overlapping locations of the slots 224, a coupling element 230 as shown in FIG. 41 is used to constrain the adjacent panels relative to each other. As the support surface assembly 220 is reshaped into different planform shapes, the coupling element 230 slides within the slots 224 as dictated by the changing position of the overlapped location between the slots 224. Suitable panels of the slotted panels 222 can be tied to underlying frames of the variable support platform or to the base support platform with intermediate panels being free to adopt positions to provide a smooth transition between panels that are tied to the underlying frames. For example, one end panel of the support surface assembly 220 can be tied to the first frame 30 of the variable support platform 28, the opposite end panel of the support surface assembly 220 can be tied to the second frame 32 of the variable support platform 28, and the center panel of the support surface assembly 220 can be tied to the third frame 34 of the variable support platform 28, thereby leaving all the remaining untied panels to reposition to suitable locations consistent with the geometry of the slots 224 such that the support surface assembly 220 has a planform with smoothly curved edges.

Figure 42:
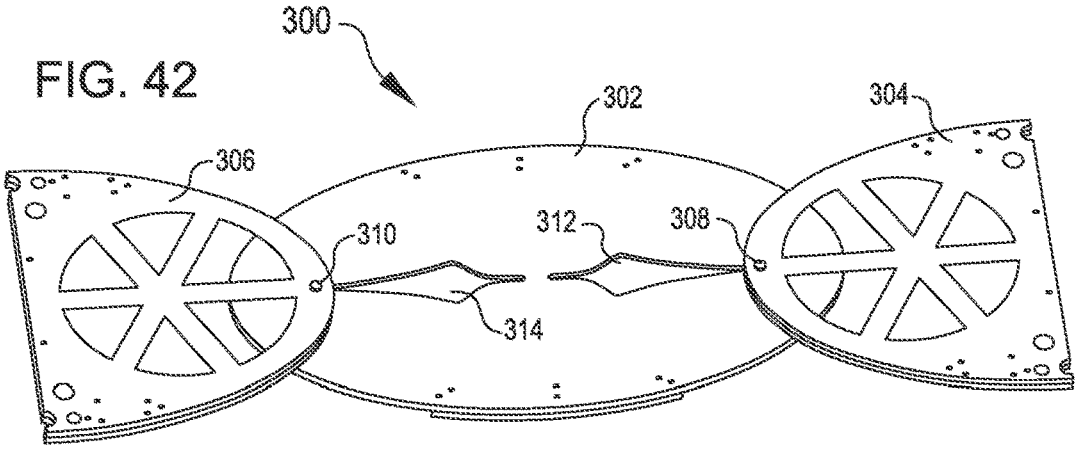
FIG. 42 is shows a perspective view of an alternate embodiment of a support platform.

FIG. 42 shows an alternate embodiment of a support platform 300. The support platform 300 includes a center ellipse 302 and outer half ellipses 304, 306. Pins 308, 310 attached at distal ends of the outer half ellipses 304, 306 extend through slots 312, 314 on the center ellipse.

In addition to the slots 312, 314, the center ellipse 302 includes distal holes 316, 318 at opposite ends of the ellipse. As further described below, the pins 308, 310 may alternatively connect through either the slots 312, 314 or the holes 316, 318. These two different connections provide a variety of configuration options for the support platform 300.

Figure 43:
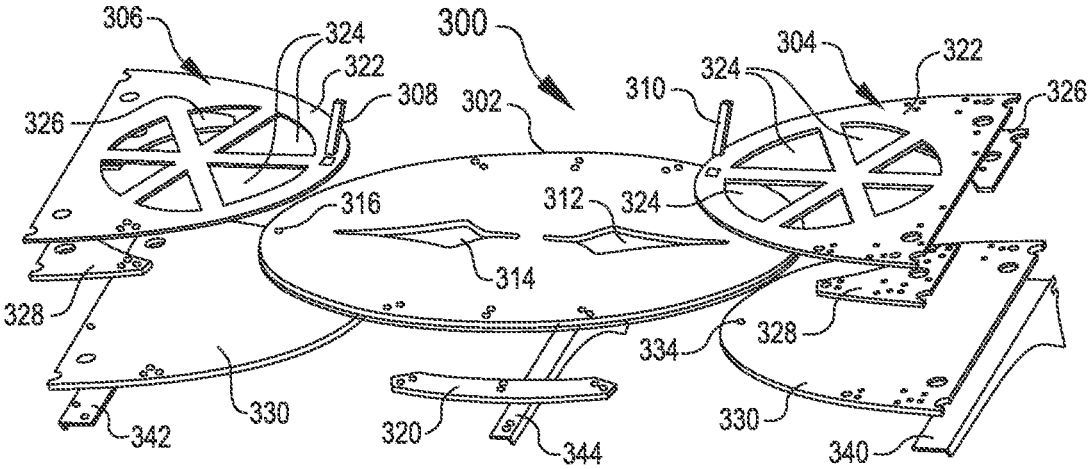
FIG. 43 is an exploded perspective view of the support platform of FIG. 42.

As shown in FIG. 43, each of the outer half ellipses 304, 306 includes a top plate 322, which may be, for example, an aluminum plate, such as 5052 aluminum, 1/32 inch thick. The top plates 322 can include openings 324 to lessen weight of the support platform 300 and/or to add aesthetic appeal.

Wedges 326, 328 are sandwiched between the top plates 322 and bottom plates 330 for the outer half ellipses 304, 306. The wedges 326, 328 can be the same height as the center ellipse 302, thereby spacing the top plates 322 and bottom plates 330, forming slots between the top plate 322 and the bottom plate 330 for slidably receiving the distal ends of the center ellipse 302.

The outer half ellipses 304, 306 include distal holes 332, 334 for receiving the pins 308, 310. As described earlier, the pins 308, 310 can be alternatively attached to the slots 312, 314 or the holes 316, 318 of the center ellipse 302. To this end, the pins 308, 310 can be reattachable structures, such as fasteners, where the support surface can be used in one manner, and later changed to another configuration, or a pin could be a more permanent attachment, such as a rivet, where the support surface is set into a particular configuration and not changed.

Figure 44:
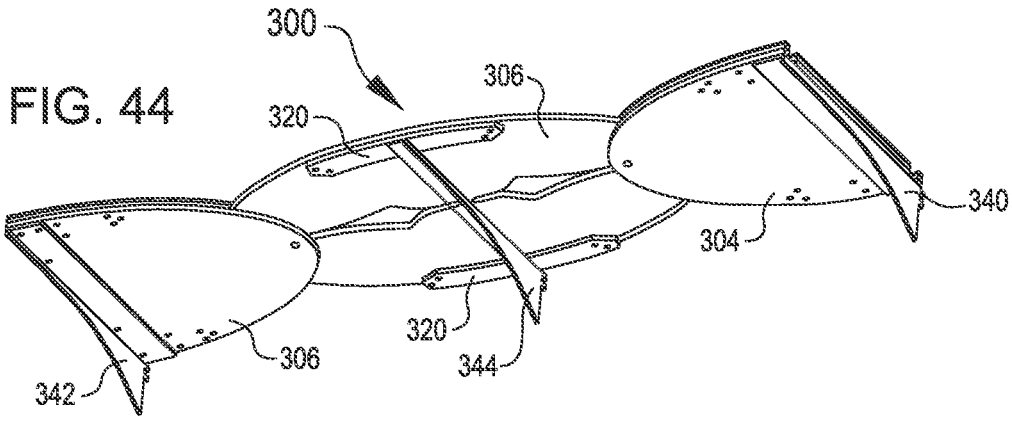
FIG. 44 is bottom perspective view of the support platform of FIG. 42, with support brackets in place.

As can be seen in FIG. 44, the support platform 300 can be supported by outer shelf brackets 340, 342 and a center shelf bracket 344. Other connection and support structures can be used, and some examples are provided with earlier embodiments.

Figure 46:
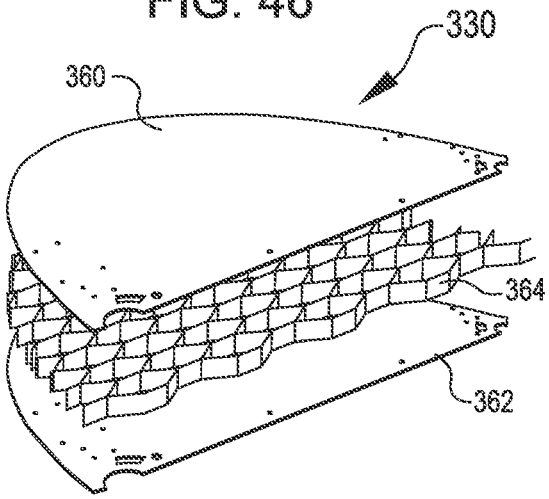
FIG. 46 is an exploded perspective view of a sandwich panel that can be used for an outer half ellipse for the support platform of FIG. 42.
Figure 47:
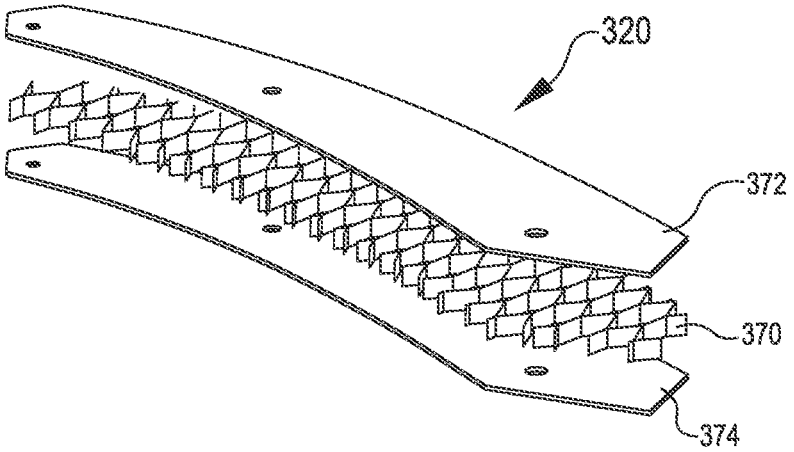
FIG. 47 is an exploded perspective view of a sandwich panel that can be used for a bridge for the support platform of FIG. 42.

In embodiments, the wedges 326, 328 (detail of a sandwich configuration not shown), the bottom plate 330 (FIG. 46), the bridges 320 (FIG. 47), and the ellipse 302 (FIG. 45) are formed of a sandwich panel configurations. By using sandwich panel configurations, these parts are very strong, but lightweight. The bridges 320 provide further lightweight support and strength for the outer edges of the ellipse 302.

Figure 45:
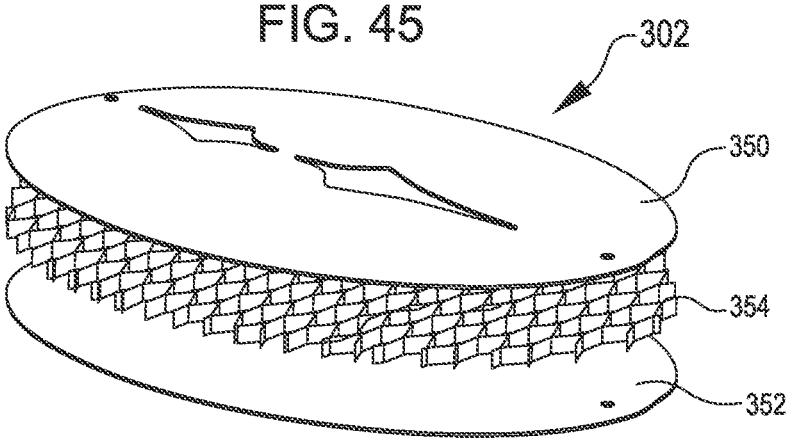
FIG. 45 is an exploded perspective view of a sandwich panel that can be used for a center ellipse for the support platform of FIG. 42.

As an example, as shown in FIG. 45, the ellipse 302 may include metal top and bottom plates 350, 352, with a center 354 having the same structure as the support surface assembly 22 described above. That is, the center 354 shown in the drawings has a structure that is formed from aligned, flexible, resilient strips where adjacent strips are attached at intervals (preferably regular intervals), and opposite adjacent strips are attached offset to one another so that, as the structure is pulled apart, waveforms (preferably sinusoidal) are formed by each of the individual strips. Thus, adjacent strips are inverted relative to one another. It is believed that such a structure provides a stronger, lighter structure than typical honeycomb sandwich panels. However, honeycomb sandwich panels could also be used.

In a similar manner, the bottom plate 330 (FIG. 46) can include a center 364 between metal plates 360, 362, and the bridges 320 (FIG. 47) can include a center 370 between metal plates 372, 374. The wedges 326, 328 may have a similar structure, but detail of a sandwich panel is not shown for those parts.

In embodiments, the top and bottom plates of the sandwich panels can be aluminum, such as 1/32 inch 5052 aluminum. The center may be formed, for example, of the strips described above, as an example, of 1/32 inch polycarbonate strips that are 1/8 inches tall. PETG or PET-G (Polyethylene Terephtalate Glycol-modified) can also be used. Eastman Chemical, SK Chemicals, and Artenius Italia are some PETG manufacturers. PETG is a clear amorphous thermoplastic that can be injection molded or sheet extruded.

The connection structure of the support platform 300 provides a number of different arrangements. Examples are shown in FIGS. 48-53. The slots 312, 314 are wider in locations than in others, permitting the pins 308, 310, which are connected to the distal ends of the half ellipses 304, 306 via the distal holes 332, 334, to move not only along a length of the slots, but also laterally from side to side in the variable width of the slots. In embodiments, such as is shown in FIG. 42, the slots 312, 314 include arced sides to as to provide smooth movement of the pints 308, 310 along the edges of the slots.

Figure 48:
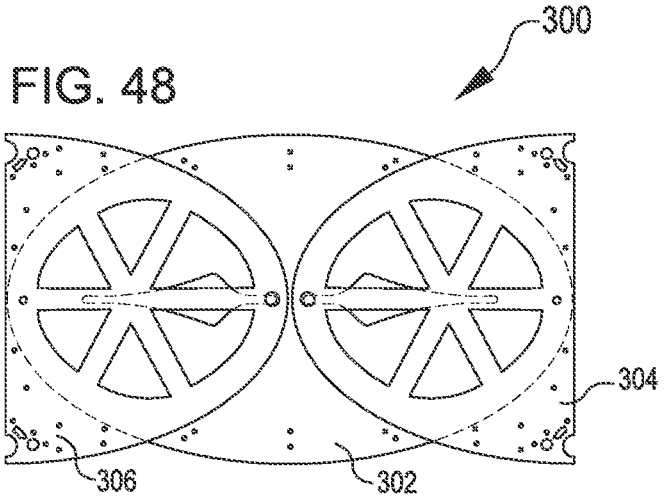
Figure 49:
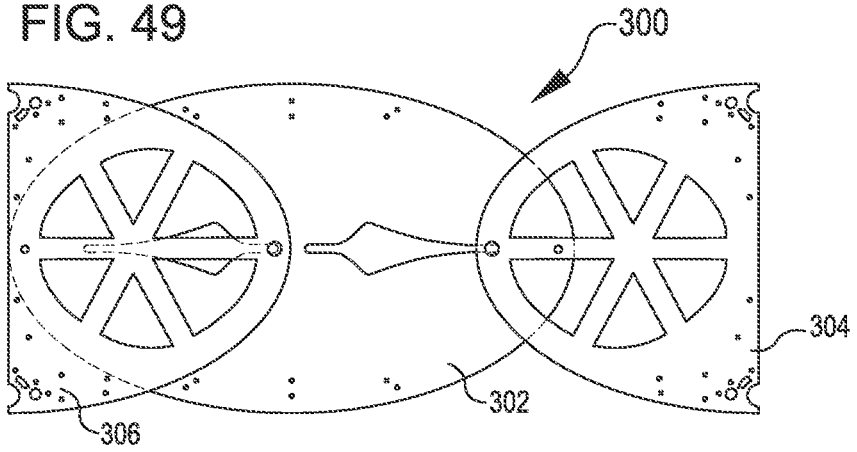

FIG. 48 shows a first arrangement of the support platform 300 where the half ellipses 304, 306 are pushed fully inward relative to the ellipse 302, providing a short, straight support. This support may be, for example, 3 feet in length. FIG. 49 shows a second arrangement where the half ellipse 304 is pulled outward relative to the ellipse 302, adding length to the support platform, but with the support platform still being straight. This arrangement may be, for example, 4 feet in length.

Figure 50:
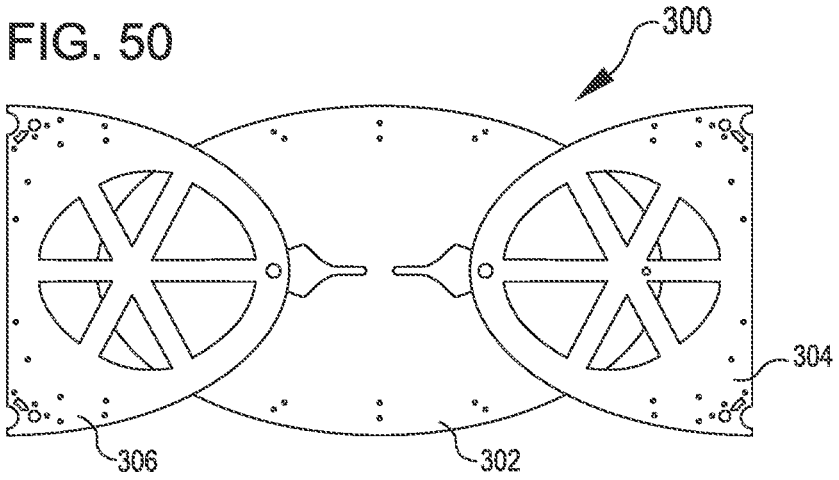
Figure 51:
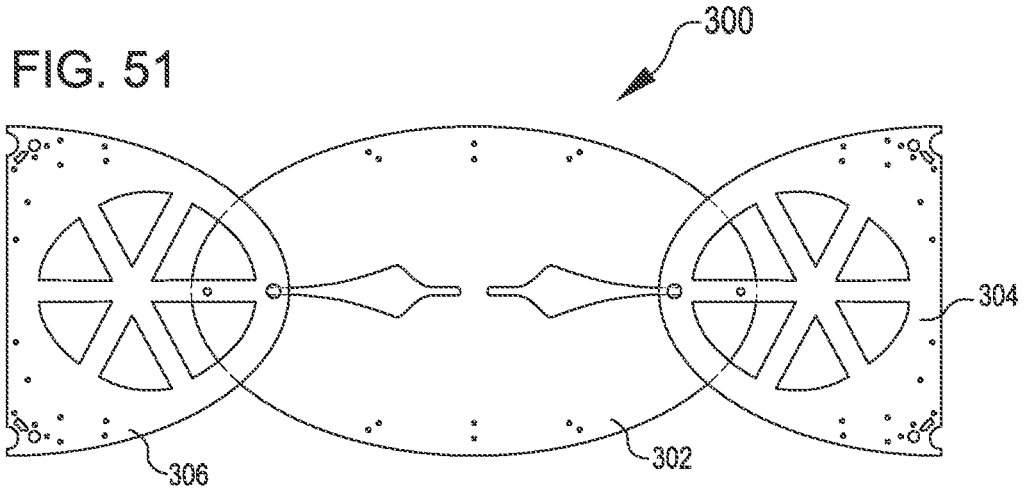

FIG. 50 is another arrangement where both half ellipses 304, 306 are pulled about half way out. This arrangement may also be, for example, 4 feet in length. FIG. 51 shows yet another arrangement where the half ellipses 304, 306 are pulled fully outward. This arrangement may permit support for a 5 foot shelf, for example.

The elliptical shape of the ellipse 302 and the half ellipses 304, 306 balances the goals of maximizing the amount of turning radius permitted between the ellipse and the half ellipses while providing maximum surface area support by the half ellipses to the ellipse. Moreover, the ellipse 302 and the half ellipses 304, 306 permit the outer edges of the support surface 300 to be rounded, regardless of the orientation, and thus the support surface assemblies 22 can provide a smoothly contoured shelf regardless of orientation of the ellipse 302 and the half ellipses 304, 306.

As an example, FIG. 53 shows the half ellipses 304, 306 each rotated about 45 degrees, forming a snake pattern. The rounded corners of the half ellipses 304, 306 and the ellipse 302 permit the support surface assembly 22 (not shown in the figure) to extend around the dramatic turns formed by the bent support surface 300 and provide smooth, rounded transitions.

FIG. 52 shows an alternate arrangement where the pins are attached to the ellipse 302 at the distal holes 316, 318 instead of the slots 312, 314. In this arrangement, the half ellipses 304, 306 can turn up to 90 degrees relative to the ellipse 302, and the elliptical shape of the slots in the half ellipses 304, 306 provides sufficient surface area to support the ellipse 302, without permitting its rotation. In addition, the rounded outer surfaces of the ellipse 302 and the half ellipses 304, 306 permit the support surface assemblies 22 to form around the dramatic turns.

Figure 54:
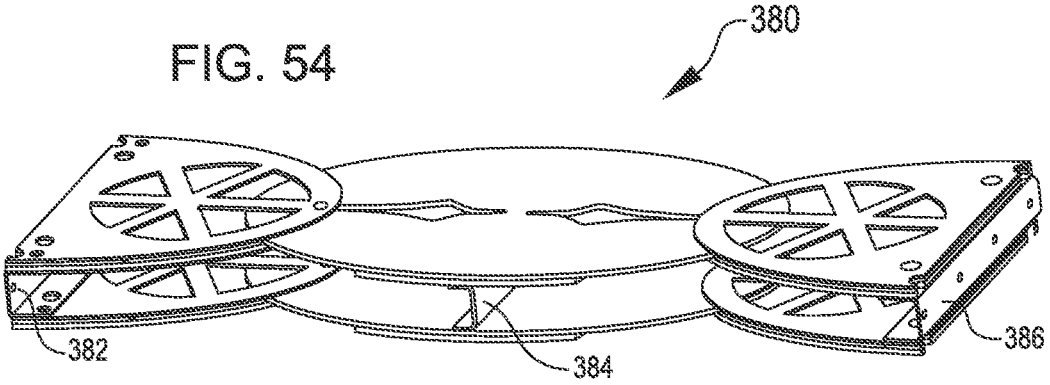
FIG. 54 is a perspective view of a base support platform in accordance with embodiments.

FIG. 54 shows an embodiment of a base support platform 380 having two structures similar to the support platform 300 separated by brackets 382, 384, and 386. The base support platform 380 can be arranged similar to the base support platform 380.

Figure 55:
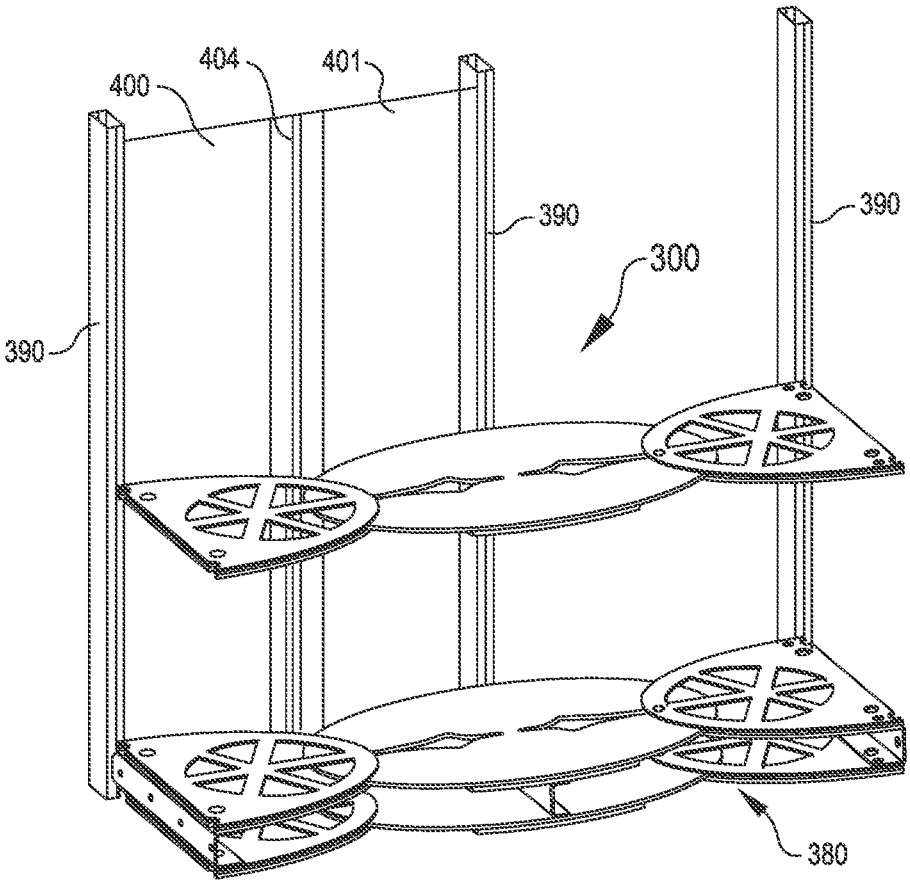
FIG. 55 is a perspective view of a shelving system incorporating the support platform of FIG. 42 and the base support platform of FIG. 54.

As can be seen in FIG. 55, the base support platform 380 and the support platform 300 can be attached to a series of posts 390 to form a shelving system. Additional support platforms 300 may be added as desired, and the ellipses and half ellipses of the base support platform 380 and the support platform 300 can be arranged to a desired shape for the shelves, and then be covered by the support surface assemblies 22. In embodiments, the posts 390 are free standing so that the ellipses and half ellipses of the base support platform 380 and the support platform 300 can be arranged to a desired shape and the posts can be moved accordingly.

Figure 56:
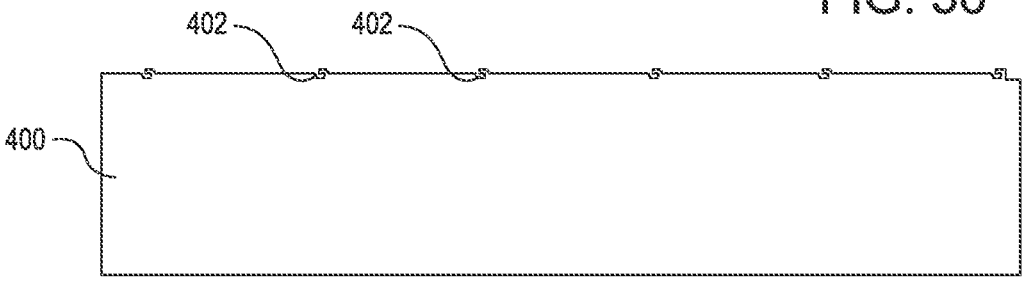
FIG. 56 is a top view of a backing that can be used in the shelving system of FIG. 55, in accordance with embodiments.

FIG. 56 shows a flexible plastic backing 400 that may be used as a backing for the shelving system shown in FIG. 55. Because the size of the shelving and therefore the width of the backing is based on the configuration of the base support platform 380 and the support platform(s) 300, a backing of a fixed width would not fit many configurations. To address this issue, the backing 400 is configured to attach to one of the posts 390, in this particular embodiment, via tabs 402 that insert into slots (not shown) on the posts. A second backing 401 (FIG. 55) is attached to a second, adjacent post 390, and the two backing overlap. The amount of overlap is sufficient so that the two backings can fill the space between the two posts 390, regardless of the configuration of the shelving.

The two backings 400, 401 may be held together using a variety of methods, including more permanent methods, such as glue, rivets, or fasteners. In the embodiment shown in FIG. 55, a long magnet strip 404, which is hinged at a top and includes opposite polarity strips on two sides, is arranged so that the two strips extend along opposite sides of the two backings. The long magnet strip 404 can be easily removed or adjusted to set the backings 400, 401 to a desired combined width. Although only one set of backings 400, 401 is shown on for the left side of the shelving in FIG. 55, a similar set can be provided for the right side of the shelving.

Figure 57:
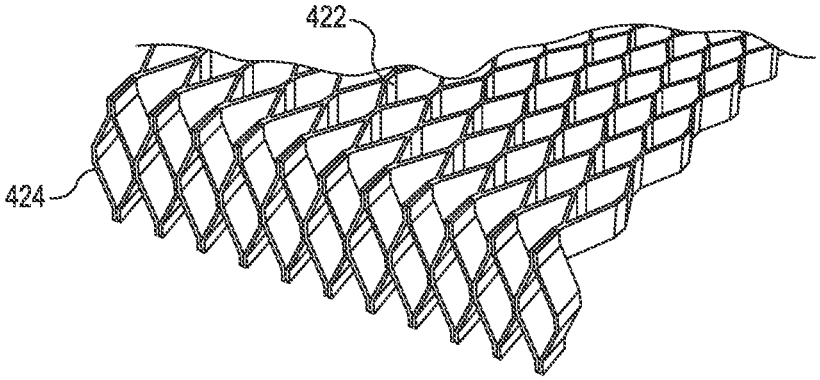
FIG. 57 is a cutaway perspective view of a support surface assembly in accordance with embodiments.
Figure 58:
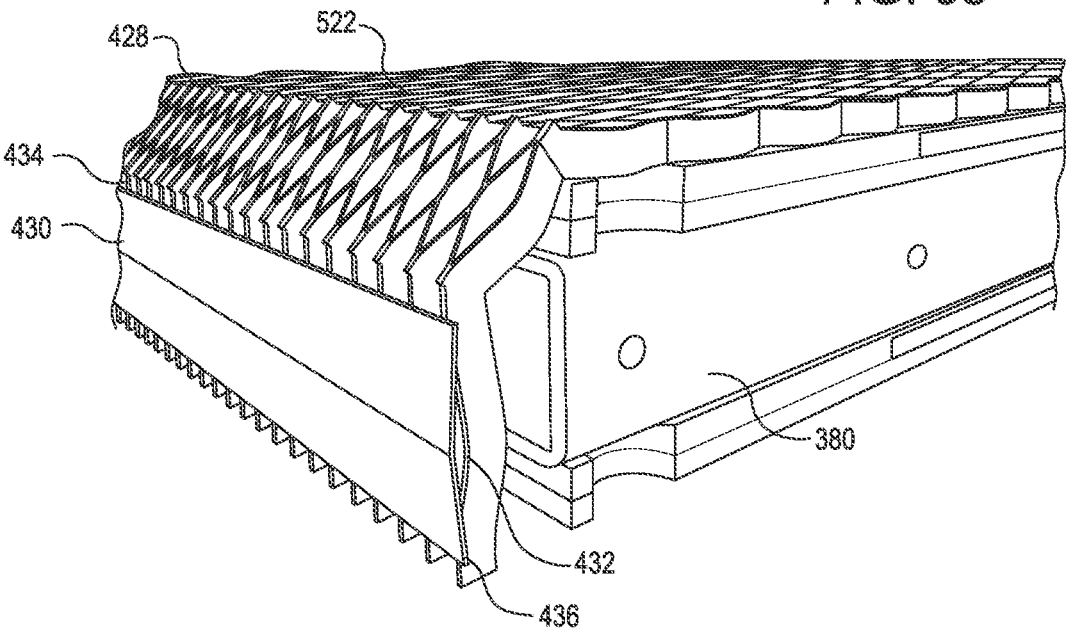
FIG. 58 is a cutaway perspective view of a support surface assembly in accordance with additional embodiments.

The base support platform 380 and the support platform(s) 300 can be covered by support surface assemblies, such as the support surface assemblies 22 described above, to provide a planform shelving system. In addition, in accordance with embodiments, as shown in FIG. 57, a support surface assembly 422 can include a front plate 424 that extends across a front of the base support platform 380 and the support platform(s) 300. FIG. 57 shows such a front plate 424 for the support surface assembly 422, with the front plate for fitting across the front of the support platform 300, and FIG. 58 shows a front plate 426 for a support surface assembly 522, with the front plate for fitting across the front of the base support platform 380.

Front plates, such as the front plates 424, 426, can take any configuration, but in embodiments are configurable with (i.e., stretch or bend with) the support surface assemblies 422, 522, and provide an aesthetically pleasing front edge for the support surface assemblies 422, 522. The front plates also provide a structure that can hook over and lock onto the front edge of the ellipse and the half ellipses. In the embodiments shown in FIGS. 57 and 58, the front plates 424, 426 are made of the same opposing strips of flexible, resilient material as the top surface of the support surface assemblies 22, 422, and 522. The front plate 424 shown in FIG. 57 extends at a right angle to the top surface, without transition. The front plate 426 shown in FIG. 58 includes a transition area 428, stepping to the front plate, with each creating an angle of about 45 degrees with the adjacent piece.

In embodiments, the front plates 424, 426 provide a location for the mounting of price tags or other signage, and in the case of the base support platform 380, can receive a kick plate. To this end, a slot, groove, or other structure can be provided for receiving a kick plate or price tag plate. Also, in alternate embodiments, a separate structure (not shown) can be mounted on the front plates 424 and/or 426 for receiving the strips. Like the backing, two or more plates can be received in the groove, slot, or other structure so that the plates may stretch to cover the support surface assemblies 422, 522 regardless of the configuration of the base support platform 380 and the support platform(s) 300.

The kick plates or price tag plates can be formed of any suitable material, but in embodiments is a flexible plastic that can conform to the front edge of the support surface assembly 422, 522. In addition, in embodiments, the kick plates or price tag plates can be paperboard or another material on which signage or decoration can be printed.

As an example, as shown in FIG. 58, a kick plate 430 is mounted in a groove 432 formed in the front edge of the front plate 426. The groove 432 is formed by tabs 434, 436 at upper and lower extremities of the groove. The tabs hold the kick plate 430 in place. Although not shown, as discussed above, multiple kick plates 430 may be mounted in the groove 432 and may overlap at ends. The multiple kick plates permit an installer to arrange the kick plates 430 to cover the entire front of the support surface assembly 522, regardless of its length or configuration.

Figure 59:
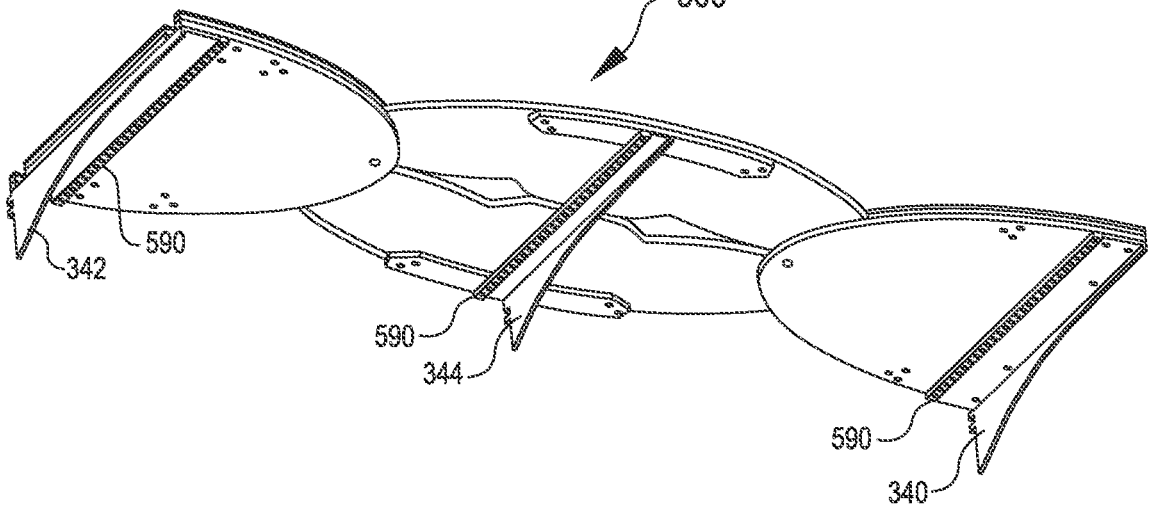
FIG. 59 is a perspective view of an underside of a support platform having lighting attached.

A planform shelving system having at least a second shelf support platform 300 elevated over an additional shelf support platform 300 or base support platform 380 may be provided (see e.g., FIG. 55). In various embodiments, an underside of the second shelf 300 comprises at least one light source. For example, FIG. 59 is a perspective view of an underside of a support platform 300 having a light source 590 attached. In embodiments, the light source 590 is a strip of light emitting diodes. Light source 590 can be attached directly to shelf 300, directly to a shelf bracket such as shelf brackets 340, 342 and 344, directly to any other feature disposed below or on an underside of shelf 300, or to some combination thereof.

Figure 60:
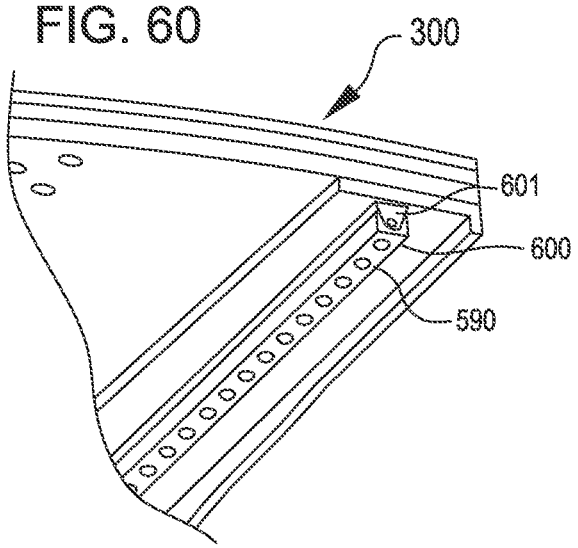
FIG. 60 is a perspective detail view of an underside of a support platform with a swiveling light box.

FIG. 60 is a perspective detail view of an underside of a support platform 300 with a swiveling light box. In embodiments, the light source 590 is mounted in a light box 600, which is coupled to the underside of support platform 300 by a swivel mount 601. Swivel mount 601 can be attached directly to shelf 300, directly to a shelf bracket such as shelf brackets 340, 342 and 344, directly to any other feature disposed below or on an underside of shelf 300, or to some combination thereof. The swivel mount 601 allows the light box 600 to swivel or pivot in order to adjust the direction of light emitted from the light source 590 and adjust the lighting of objects below the frame of support platform 300.

Figure 61:
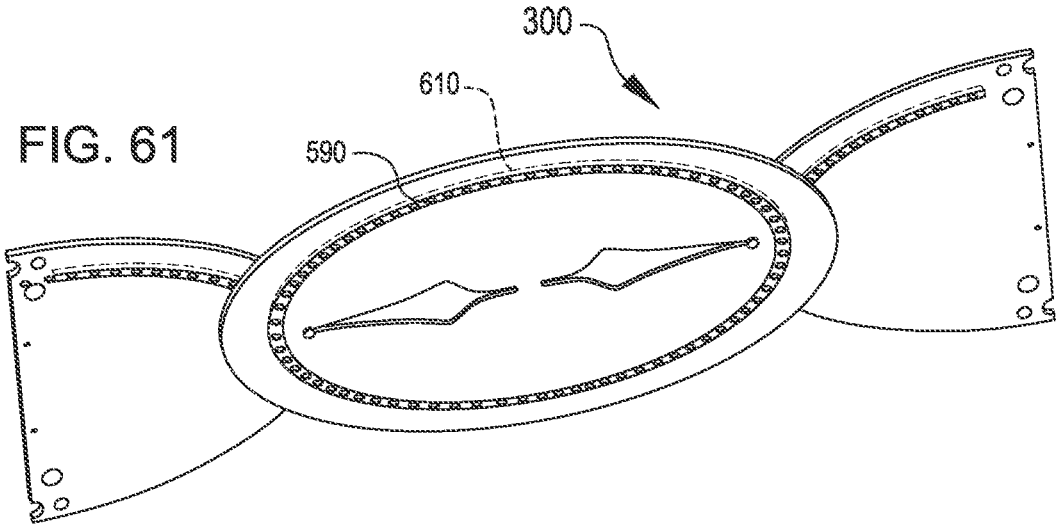
FIG. 61 is a perspective view of an underside of a support platform having recessed lighting.

FIG. 61 is a perspective view of an underside of a support platform 300 having recessed lighting. In embodiments, one of the frames of the second shelf 300 comprises a machined recess 610 on the underside of the second shelf 300 for receiving at least one light source 590. In embodiments, the machined recess allows for a lighting source 590 to be included without protruding from the underside of the frame of the second shelf 300, allowing the second shelf 300 with a light source 590 to be used with the same supports 340, 342, 344, etc. used for a support platform 300 without light sources 590.

Figure 62:
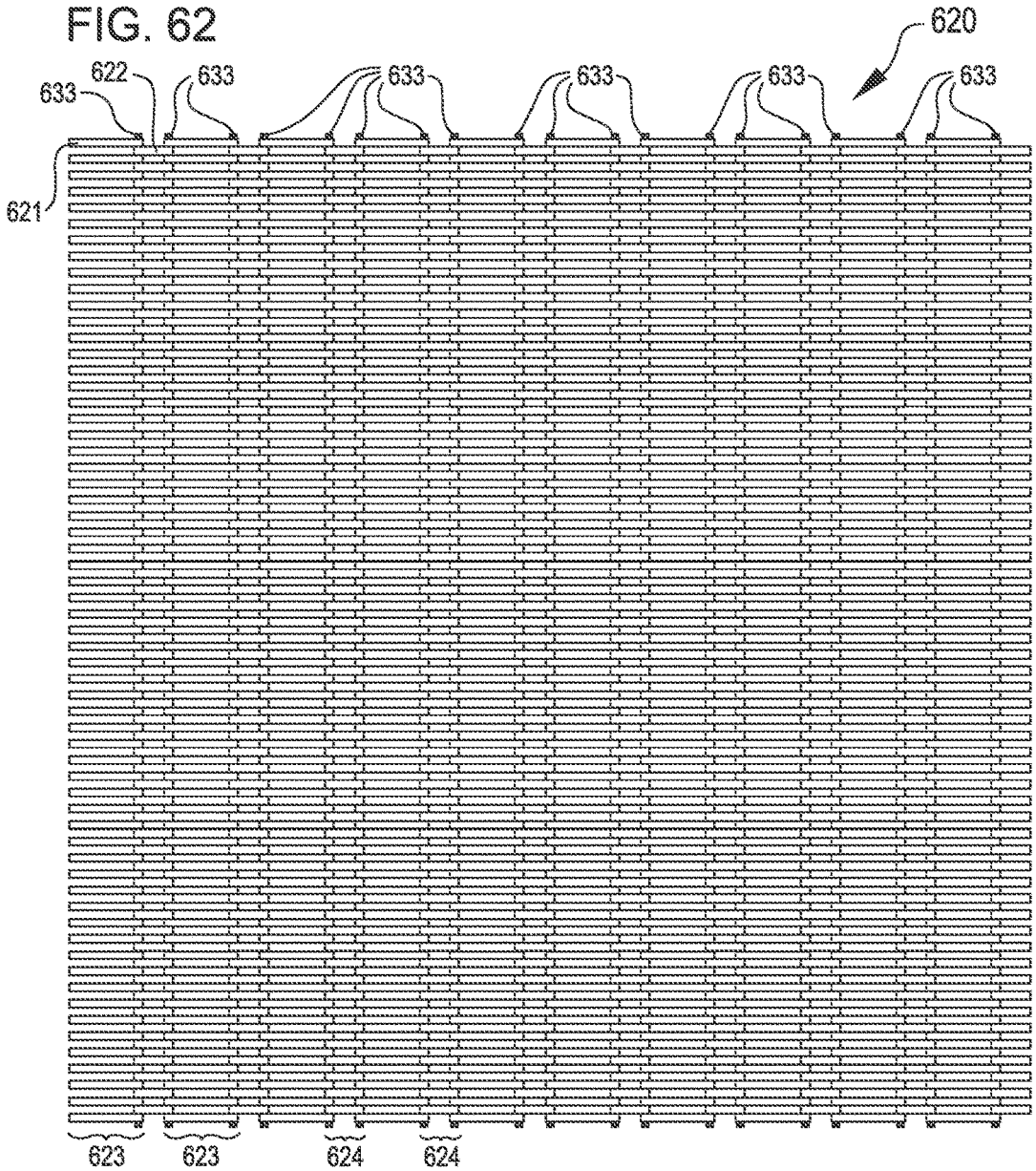
FIG. 62 is a rear view of moveable slat that can be used as an adjustable backing in a variable planform shelving system in accordance with various embodiments, such as the system shown in FIG. 55.
Figure 63A:
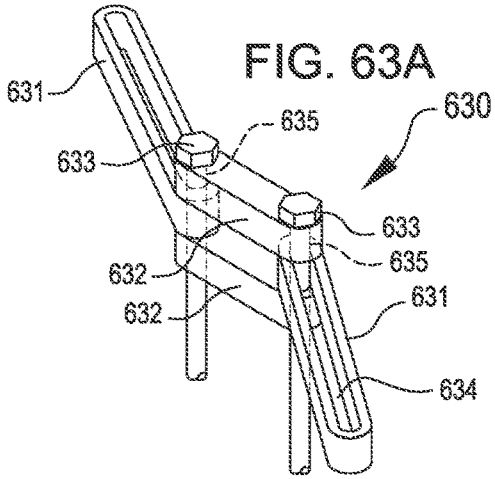
FIG. 63A is a detail view of a linkage within the moveable slat of FIG. 62.

FIG. 62 is a rear view of moveable slat 620 that can be used as an adjustable backing in a variable planform shelving system in accordance with various embodiments, such as the system shown in FIG. 55. FIG. 63A is a detail view of a linkage 630 within the moveable slat 620 of FIG. 62.

In embodiments, a movable slat 620 is provided as an adjustable backing between adjacent support columns 390 of a planform shelving system. In some embodiments, the movable slat 620 comprises a plurality of slot links 631, a plurality of solid links 632, and a plurality of long pin members 633. Each of the plurality of slot links 631 comprises a vertical slot 634 through a height of the slot link 631. This slot 634 is configured to receive at least one long pin member 633 for at least horizontal sliding of the pin member 633 along a length of the slot 634. Each of the plurality of solid links 632 comprises a through-hole 635 at each of two ends of a body of the solid link 632, and each through-hole 635 is configured to receive one long pin member 633. To construct the slat 620, a subset of each of the plurality of slot links 631 and the plurality of solid links 632 are disposed in an alternating stacked pattern so that slots 634 and through-holes 635 are aligned in a stack. A long pin member 633 is passed vertically alternately through the solid links 632 and slot links 631 in the stack to form a joint in the movable slat 620, the joint made up of solid links 632 and slot links 631 coupled by the pin 633. In this configuration, the solid links 632 constrain the pin 633 in place but allow the coupled slot links 631 to slide and pivot relative to the pin 633. The slot links 631 provide spaces between consecutive solid links 632. Another subset of slot links 631 can be placed into these spaces such that slots 634 in the newly added slot links 631 align with the unoccupied through-holes 635 in second ends of the coupled solid links 632, providing a path for the insertion of another long pin member 633 to form another joint in the slat 620. Thus, as shown in FIG. 63A, each solid link 632 constrains two pins 633 for coupling slot links 631 to either end of the solid link 632. The coupled slot members 631 are free to slide and rotate relative to the pin 633. When the coupled slot links 631 are additionally coupled to another subset of solid links 632 within a larger backing assembly of slat 620, they provide a sliding and pivoting interface which allows a variability in stretching and contouring of the slat 620 which is very suitable for following the dramatic changes of length and shape possible with the variable planform shelving system.

In embodiments, the movable slat comprises a plurality of first links 621, a plurality of second links 632, and a plurality of long pin members 633. Each of the plurality of first links 621 includes a vertical opening 634 through a height of the link 621, and the opening is configured to receive at least one long pin member 633 to align the link 621 with other links. The plurality of first links 621 is aligned into columns 623 of vertically aligned first links 621. Each of the plurality of second links 622 comprises at least one vertical opening 634 through a height of the link 622, and each opening 634 is configured to receive at least one long pin member 633 to align the link 622 with other links. The plurality of second links 622 is aligned into columns 624 of vertically aligned second links 622. Each column 624 of second links 622 is disposed between adjacent columns 623 of first links 621 so that the columns 623 of first links 621 and the columns 624 of second links 622 are disposed in an alternating pattern. Each pin 633 in the plurality of long pin members 633 passes through at least some first links 621 in a first link column 623 and passes through at least some second links 622 in an adjacent second link column 624. The result is that the first link column 623 is joined to the adjacent second link column 624 by a common pin 633, providing a joint within a movable slat 620. In some embodiments, in at least one of the columns 623 of first links 621 in the movable slat 620, the first links 621 in the column are disposed so that gaps exist between at least some vertically consecutive first links 621, and at least one second link 622 that is part of an adjacent second link column 624 is disposed between vertically consecutive first links 621 and has a height which determines the size of at least one gap.

Figure 63B:
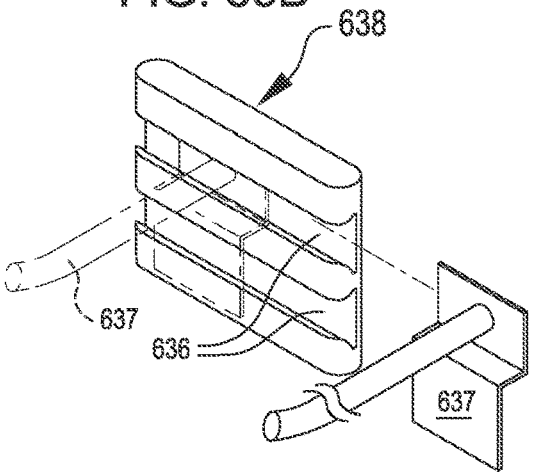
FIG. 63B is a detail view of a link within the moveable slat of FIG. 62 in accordance with various embodiments.

FIG. 63B is a detail view of a link within the moveable slat of FIG. 62 in accordance with various embodiments. As shown in FIG. 63B, in various embodiments, link 638 can include at least one groove 636 configured to receive a hanger 637. Hanger 637 can be any type of hardware configured for use as accessories in a slat wall system as known in the art, including but not limited to prongs, bars, hooks, posts, brackets, clips, arms, plates, faceouts, holders, racks, tubing, fixtures, shelves, and baskets. In some embodiments, link 638 is an add-on component to a link already in the slat 620 (such as any of links 621, 622, 631, and 632). In some embodiments, link 638 is modified to include at least one vertical opening (such as either of 634 and 635) for use as a link in the slat 620 (such as any of links 621, 622, 631, and 632).

Figure 64:
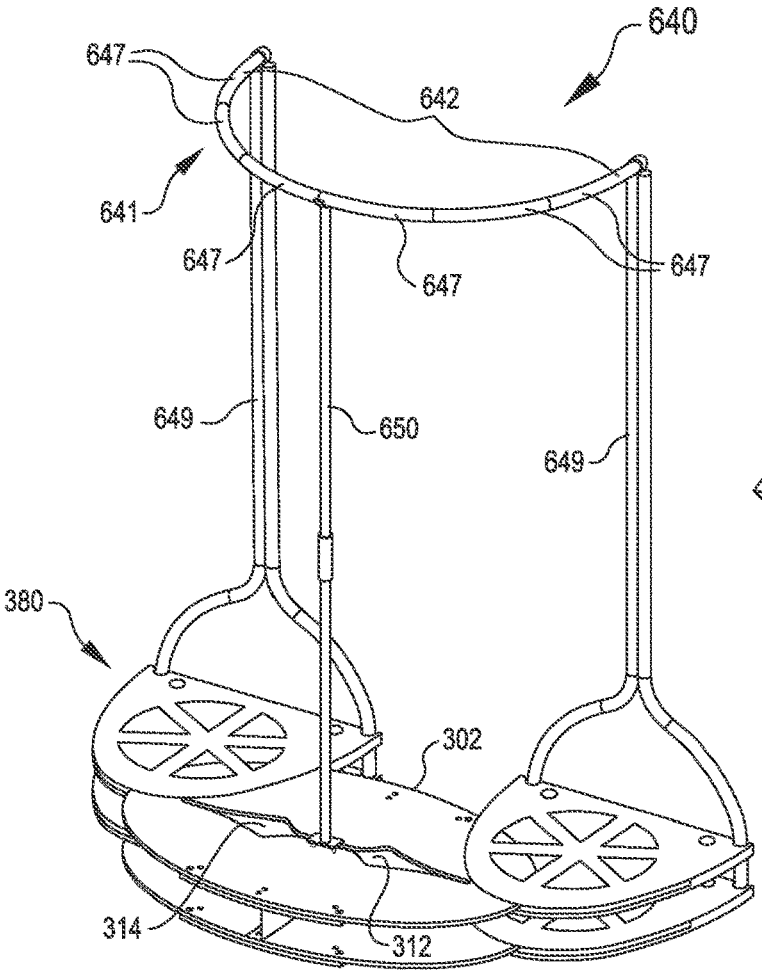
FIG. 64 is a perspective view of a variable-length clothes rack having a variable-planform base and a top rack with interchangeable segment members, in accordance with many embodiments.
Figure 65:
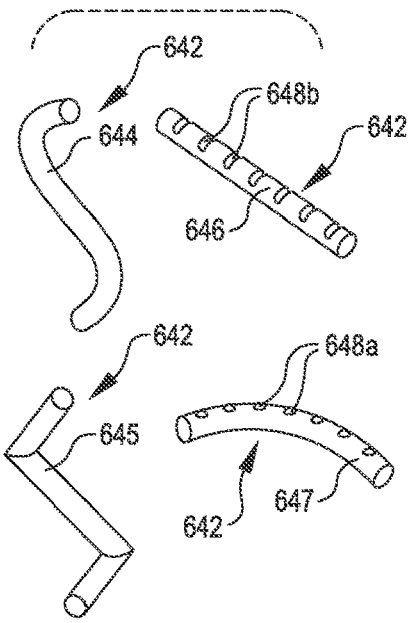
FIG. 65 shows example interchangeable segment members for use in the top rack with interchangeable segment members of FIG. 64, in accordance with many embodiments.
Figure 66:
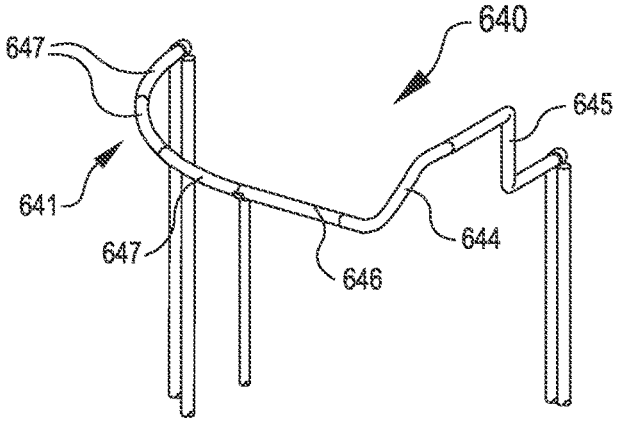
FIG. 66 is a partial perspective view of a variable-length clothes rack having a variable-planform base and a top rack with differing interchangeable segment members, in accordance with many embodiments.

FIG. 64 shows a perspective view of a variable-length clothes rack 640 having a variable-planform base 380 and a top rack 641 with interchangeable segment members 642, in accordance with many embodiments. In embodiments, the top rack 641 comprises a plurality of shaped interchangeable members 642 which together form a shape of the top rack 641. In order to vary the shape of the top rack 641, at least some of the shaped interchangeable members 642 may be replaced with other shaped interchangeable members 642. FIG. 65 shows example interchangeable segment members 642 for use in the top rack 641 of FIG. 64, in accordance with many embodiments. By replacing interchangeable members 642 of one shape for interchangeable members of another shape, the top rack 641 may be varied according to preference or design criteria. For example, as shown in FIG. 64, all shaped interchangeable members 642 are curved members 647. However, by replacing several of curved members 647 with a combination of S-members 644, Z-members 645, and straight-members 646 shown in FIG. 65, a shape of top rack 641 shown in FIG. 64 can be converted to a shape of top rack 641 shown in FIG. 66. Other shapes of interchangeable segment members 642 may be provided in addition to those example shapes shown in FIG. 65. Since interchangeable segment members 642 are not limited to the example shapes shown in FIG. 65, any number of variations on the shape of top rack 641 are possible in various embodiments.

Clothesrack 640 can be configured for use with standardized clothes hangers. In many embodiments, the diameter or shape of interchangeable segment members 642 is selected to accommodate such standardized clothes hangers. In some embodiments, as shown in FIG. 64, at least one interchangeable segment member 642 has at least one nub 648A and/or at least one notch 648B which can function to keep such clothes hangers in place on top rack 641. The ability to keep clothing hangers in place can be particularly useful for maintaining an organized or visually appealing display of clothing when the risk of the hangers becoming bunched together is high, such as when the racks are to be moved or experience high volumes of customer perusal.

Figure 67:
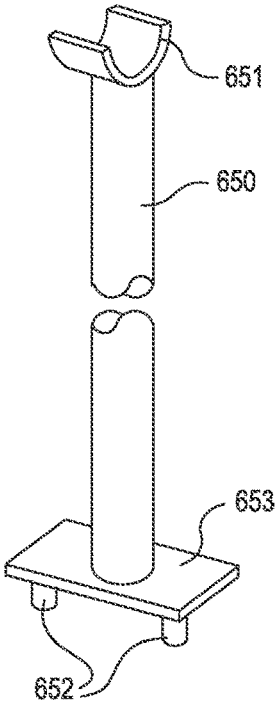
FIG. 67 shows end details of a third support member for the clothing rack with top rack interchangeable segment members of FIG. 64, in accordance with many embodiments.

In accordance with many embodiments, FIG. 67 shows end details of a third support member 650 for use in the adjustable clothing rack 640 with top rack 641 with interchangeable segment members 642 shown in FIG. 65. In some embodiments, a variable-length clothes rack 640 with top rack 641 of differing interchangeable segment members 642 can also include a third support column 650 to supplement support provided to top rack 641 by end support columns 649. Third column 650 is supported by center ellipse 302. In some embodiments, third column 650 can be telescoping in order to change size to support top rack 641 regardless of how interchangeable segment members 642 vary a position of top rack 641 up or down. In embodiments third column 650 can comprise a mount 651 located at a top end of the third support column 650. Mount 651 can be configured to conform to a common cross section of the shaped interchangeable members 642 to provide a secure coupling between the third support column 650 and the top rack 641. Mount 651 can also comprise a magnet to achieve this secure coupling when the interchangeable members 642 are either made of metal or also fitted with magnetic attachment points. In embodiments, the third support column 650 comprises at least one prong 652 at a base 653 of the third support column 650 to be received by a slot 312 or 314 in the elliptical third frame 302 for attaching the third support column 150 to the elliptical third frame 302.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A reconfigurable shelving unit, comprising:

a support frame assembly comprising a plurality of support frames that are configured for re-arranging relative to one another between different configurations so as to change a footprint of the support frame assembly by at least one of (a) changing a curvature of the support frame assembly or (b) changing the curvature of the support frame assembly and a length of the support frame assembly; and a support surface assembly supported by the support frame assembly and forming a reconfigurable support surface for items supported by the support frame assembly, the support surface assembly comprising a plurality of interconnected flexible panels so as to be reconfigurable to match at least a portion of a shape of the support frame assembly responsive to a changing of the footprint of the support surface assembly, the support surface assembly further comprising a front plate assembly affixed to a front surface of the support surface assembly, the front plate assembly comprising a step down portion disposed approximately 45 degrees relative to a top of the reconfigurable support surface and a vertical portion disposed approximately 90 degrees relative to the top of the reconfigurable support surface;

wherein the plurality of interconnected flexible panels have longitudinal and depth dimensions that define faces oriented to extend in the vertical direction, the vertical direction orientation of the faces does not change with a reconfiguration of the support surface assembly variable in size, shape, and curvature in a width-wise direction perpendicular to the vertical direction and traverse a lengthwise direction, and each one of the plurality of interconnected flexible panels comprises flexible and resilient strips.

2. The support surface assembly of claim 1, wherein the plurality of interconnected flexible panels comprises a plurality of vertically-oriented interconnected flexible panels.

3. The support surface assembly of claim 1, wherein the support surface assembly is expandable in the lengthwise direction without substantial contraction in the support surface assembly in the width-wise direction.

4. The support surface assembly of claim 1, wherein the plurality of interconnected flexible panels are intermittently bonded to each other at a regular interval of 3.8 centimeters (1.5 inches) to provide a sinusoidal pattern.

5. The support surface assembly of claim 4, wherein the support surface assembly comprises a plurality of interconnected flexible members such that distances between adjacent flexible members at locations between bonded areas are maintainable below distances which ensure that the support surface assembly does not contract to a substantial extent transverse to an expansion direction of the support surface assembly when the support surface assembly is expanded.

6. The support surface assembly of claim 1, wherein the flexible and resilient strips comprise at least one of polycarbonate strips, acrylic strips, or acrylic abrasion resistant strips.

7. A support surface assembly forming a reconfigurable support surface upon which to support items in a vertical direction from underneath, the support surface assembly comprising:

a plurality of panels having longitudinal and depth dimensions that define faces oriented to extend in the vertical direction, the faces being intermittently bonded to each other so that the panels assume a sinusoidal pattern, the panels being flexible so that portions of the panels in between bonded areas are flexible to render the support surface assembly (a) expandable in a lengthwise direction perpendicular to the vertical direction of the plurality of flexible panels without a substantial contraction in the support surface assembly in a width-wise direction transverse to the lengthwise direction and without a change in the vertical direction orientation of the faces and (b) variable in size, shape, and width-wise curvature of the support surface assembly; and a front plate assembly affixed to a front surface of the support surface assembly, the front plate assembly comprising a step down portion disposed approximately 45 degrees relative to a top of the reconfigurable support surface and a vertical portion disposed approximately 90 degrees relative to the top of the reconfigurable support surface;

wherein the vertical direction orientation of the faces does not change with a reconfiguration of the support surface assembly, and each one of the plurality of interconnected flexible panels comprises flexible and resilient strips.

8. The support surface assembly of claim 7, wherein the intermittent bonding is at a regular interval of 3.8 centimeters (1.5 inches) to provide a sinusoidal pattern.

9. The support surface assembly of claim 1, wherein the support surface assembly is fabricated on a mold.

10. The support surface assembly of claim 9, wherein the support surface assembly comprises a plurality of interconnected flexible members such that distances between adjacent flexible members at locations between bonded areas are maintainable below distances which ensure that the support surface assembly does not contract to a substantial extent transverse to an expansion direction of the support surface assembly when the support surface assembly is expanded.

11. The support surface assembly of claim 7, wherein the flexible and resilient strips comprise at least one of polycarbonate strips, acrylic strips, or acrylic abrasion resistant strips.

12. The support surface assembly of claim 7, wherein the support surface assembly is fabricated on a mold.

13. The support surface assembly of claim 7, wherein the support surface assembly is incorporated into a reconfigurable shelving unit that further comprises:

a support frame assembly comprising a plurality of support frames that are configured for re-arranging relative to one another between different configurations so as to change a footprint of the support frame assembly by at least one of (a) changing a curvature of the support frame assembly or (b) changing the curvature of the support frame assembly and a length of the support frame assembly;

wherein the support surface assembly is supported by the support frame assembly and forms a support surface for items supported by the support frame assembly; and wherein the support surface assembly is configured to vary in at least one of a size or a shape in response to and in accordance with variation of the footprint of the support surface assembly.

* * * * *